US011453005B2

(12) United States Patent
Drazer et al.

(10) Patent No.: US 11,453,005 B2
(45) Date of Patent: Sep. 27, 2022

(54) ANCHORED-LIQUID STATIONARY PHASE FOR SEPARATION AND FILTRATION SYSTEMS

(71) Applicant: Rutgers, The State University of New Jersey, New Brunswick, NJ (US)

(72) Inventors: German Drazer, New Brunswick, NJ (US); Shahab Shojaei-Zadeh, New Brunswick, NJ (US)

(73) Assignee: RUTGERS, THE STATE UNIVERSITY OF NEW JERSEY, New Brunswick, NJ (US)

( * ) Notice: Subject to any disclaimer, the term of this patent is extended or adjusted under 35 U.S.C. 154(b) by 0 days.

(21) Appl. No.: 16/615,202

(22) PCT Filed: May 25, 2018

(86) PCT No.: PCT/US2018/034712
§ 371 (c)(1),
(2) Date: Nov. 20, 2019

(87) PCT Pub. No.: WO2018/218181
PCT Pub. Date: Nov. 29, 2018

(65) Prior Publication Data

US 2020/0156070 A1 May 21, 2020

Related U.S. Application Data

(60) Provisional application No. 62/511,107, filed on May 25, 2017.

(51) Int. Cl.
*B01L 3/00* (2006.01)

(52) U.S. Cl.
CPC . *B01L 3/502753* (2013.01); *B01L 2200/0668* (2013.01); *B01L 2300/0877* (2013.01); *B01L 2300/165* (2013.01)

(58) Field of Classification Search
CPC ..... B01L 3/502753; B01L 2200/0668; B01L 2300/0877; B01L 2300/165; B01L 13/02; B01L 2300/0851; B01L 2300/089; B01L 3/502746; B01L 2200/141; B01L 2300/0829; B01L 2300/166
See application file for complete search history.

(56) References Cited

U.S. PATENT DOCUMENTS

| | | | | |
|---|---|---|---|---|
| 9,427,688 | B2 * | 8/2016 | Reichenbach | B01D 43/00 |
| 2002/0001546 | A1 | 1/2002 | Hunter et al. | |
| 2004/0139858 | A1 | 7/2004 | Entezarian et al. | |
| 2008/0023399 | A1 | 1/2008 | Inglis et al. | |

(Continued)

OTHER PUBLICATIONS

Blanchard et al (High-density oligonucleotide assays, Biosensors and Bioelectronics, 1996, vol. 11, No. 6/7, pp. 687-690) (Year: 1996).*

(Continued)

*Primary Examiner* — Benjamin R Whatley
*Assistant Examiner* — Jean Caraballo-Leon
(74) *Attorney, Agent, or Firm* — Meagher Emanuel Laks Goldberg & Liao, LLP

(57) ABSTRACT

Various embodiments comprise systems, methods, architectures, mechanisms or apparatus configured to separate particles of varying size within a fluid flow, or filter particles from a fluid flow, via an array of anchored-liquid drops or anchored-gas drops.

18 Claims, 14 Drawing Sheets

(56) References Cited

U.S. PATENT DOCUMENTS

| | | | | |
|---|---|---|---|---|
| 2008/0090239 | A1 | 4/2008 | Shoemaker et al. | |
| 2010/0059414 | A1 | 3/2010 | Strum | |
| 2012/0006728 | A1 | 1/2012 | Huang et al. | |
| 2012/0037544 | A1 | 2/2012 | Lane et al. | |
| 2012/0298205 | A1 | 11/2012 | Schertzer et al. | |
| 2014/0030788 | A1 | 1/2014 | Chen et al. | |
| 2016/0047735 | A1 | 2/2016 | Grisham et al. | |
| 2016/0139012 | A1* | 5/2016 | D'Silva ..... | A61K 35/28<br>424/93.7 |
| 2016/0146717 | A1 | 5/2016 | Astier et al. | |
| 2016/0361716 | A1 | 12/2016 | Solomon | |
| 2017/0128941 | A1 | 5/2017 | Sadri et al. | |

OTHER PUBLICATIONS

International Search Report and Written Opinion for PCT/US2018/034712, dated Aug. 24, 2018.

Chinese Office Action for corresponding CN Application No. 201880048787.5, dated Jan. 29, 2022.

Blanchard et al., "High-Density oligonucleotide Arrays", Biosensors & Bioelectrinics, vol. 11, Issue 6-7, pp. 387-690, 1996.

* cited by examiner

ANCHORED-LIQUID STATIONARY PHASE FOR SEPARATION AND FILTRATION SYSTEMS

CROSS REFERENCE TO RELATED APPLICATION

This application claims the benefit of the filing date of U.S. Provisional Patent Application No. 62/511,107 filed May 25, 2017, the disclosures of which are hereby incorporated herein by reference in its entirety.

FIELD OF THE DISCLOSURE

The present disclosure generally relates to anchored-liquid arrays as fluid based membranes, such as anchored-liquid arrays arranged in periodic structures and used as stationary-phase and/or filter media.

BACKGROUND

Deterministic lateral displacement (DLD) systems are designed to separate particles of different sizes by forcing them through periodic lattice of obstacles. Due to the ability to achieve high resolution, label-free fractionation, DLD systems have been frequently employed to separate biological and chemical samples such as blood cells, cancer cells, and parasite from blood cells. More specifically, DLD obstacle lattices typically comprise solid materials of various compositions forming an array of obstacles (posts) positioned to receive a flow of particles at a forcing angle selected to achieve a desired species or particle separation. Flow may be driven by gravity, centrifugal force, electromagnetic fields and the like. While effective, current DLD systems are disadvantageously prone to clogging, not reusable, not modifiable and typically difficult to fabricate.

SUMMARY

Various deficiencies in the prior art are addressed by systems, methods, architectures, mechanisms or apparatus configured to separate particles of varying size or filter particles from a fluid via an array of anchored-liquid drops or anchored-gas drops.

In one embodiment a particle separation/filtration apparatus is formed as an array of anchored-liquid or anchored-gas drops disposed upon a first surface having a channel for receiving therethrough a fluid flow, the array generally formed as rows and columns of liquid or gas drops anchored via respective anchoring structures formed on the first surface and configured for obstructing proximate portions of the fluid flow, the array positioned to receive the fluid flow at a forcing angle selected to cause a separation of particles of a different predefined sizes within the fluid flow.

In other embodiments, the particle separation apparatus may include at least one gas reservoir channel configured to provide pressurized gas to a respective portion of the anchoring structures via the anchoring structures formed on the first surface, the pressurized gas being configured to exert sufficient pressure on surrounding fluid to maintain the array of anchored-gas drops.

BRIEF DESCRIPTION OF THE DRAWINGS

The teachings herein can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1A:
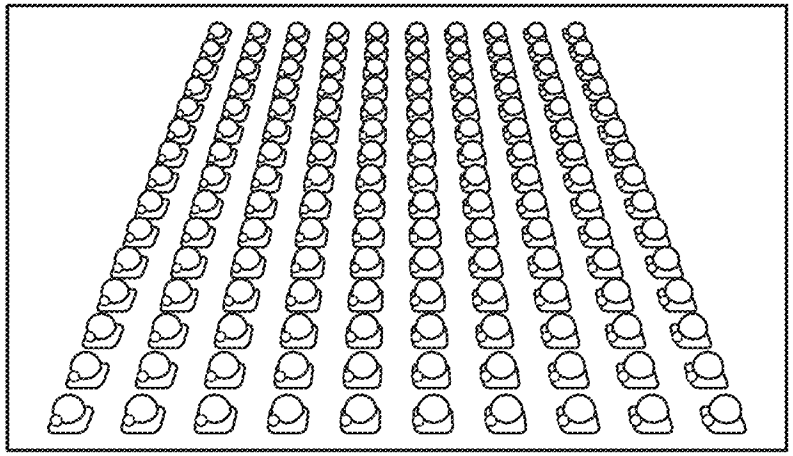
FIG. 1(*a*)-1(*d*) depicts several views of an anchored-liquid array in accordance with various embodiments.

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Various deficiencies in the prior art are addressed by systems, methods, architectures, mechanisms or apparatus using anchored-fluid arrays to create fluid-based membranes and stationary phases for a new generation of filtration and separation devices spanning multiple length scales and impacting a wide-range of applications. Various applications include applications at different scales, from standard bio-separations in microfluidic DLD devices (microscale), to the filtration of airborne particulate matter (micro/mesoscale), to wastewater treatment and oil-water separation (mesoscale). In various embodiments, anchored-liquids, arranged in periodic structures, are used as stationary-phase and/or filter media.

In particular, various embodiments find utility within a number of applications, including: Separation of suspended particles in microfluidics (immiscible liquid-liquid interface); Filtration of particulate matter in air (liquid-air interface, trap air pollutant in liquid)—air flows through the array of anchored-bridges and particulate matter will be trapped in the water columns, due to a combination of inertia effects and non-hydrodynamic interactions; Cleaning of contaminated water (water-oil interface) and so on.

Particles can be organic or inorganic. Particles can be biological in nature, which include mammalian cells, plant cells, bacteria, fungi, spores, viruses, parasites, and other microorganisms, organelles, nucleic acids, peptides, proteins, lipids, The particle separation apparatus and particle filtration apparatus can be used to separate these various biological particles or filtering out contaminants made of these biological particles from fluid flow.

Various embodiments contemplate the use of anchored-liquid arrays submerged in an immiscible continuous phase to provide separation/filtration at micro- and nano-scales. Various embodiments find utility within the context of separation of microfluidic suspended species/particles, filtration of particulate matter in air, cleaning of contaminated water and the like.

Various embodiments contemplate separation/filtration for capturing particles with an affinity for a liquid-liquid or liquid-air interface. These liquid-based stationary phases can be used as, illustratively: (i) Deterministic Lateral Displacement separation devices using anchored-liquid bridges instead of solid pillars for separation at a range of scales; (ii) anchored-liquid air-filtration devices, that take advantage of the preference for small particles to go to the air-water interface; and (iii) supercoalescers for the separation of water/oil droplets in emulsions that take advantage of the presence of attractor trajectories to create highly efficient coalescence-based separation.

Various embodiments contemplate DLD-implemented filtration/separation systems, apparatus and methods utilizing an array of anchored liquid bridges forming thereby circular and/or non-circular posts or obstacles.

Various embodiments contemplate filtration/separation systems, apparatus and methods able to fractionate samples by characteristics such as size, mass, shape, deformability and/or other characteristics.

Various embodiments contemplate filtration/separation systems, apparatus and methods driving species through a periodic array of deformable obstacles in accordance with flow, gravity, electrical force and centrifugal force. Various embodiments contemplate intra-array particle migration according to various modes such as a displacement or locked mode where the particle is locked in the direction of the posts, a zig-zag mode where particles follow the flow direction closely, a mixed motion or directional locking mode and so on.

Embodiments of DLD Systems with Anchored Liquid Bridges

Deterministic lateral displacement (DLD) systems are designed to separate different sized particles as they flow through an array of obstacles (posts). DLD systems have been utilized to separate blood cells, circulating tumor cells, and even nanoscale particles. Besides flow, gravity, electrical and centrifugal force can be used to drive particles through the array. The current invention in various embodiments relates to an idea of using anchored liquids (e.g. water droplets) arranged in special periodic structures as stationary-phase filtering media (anchored-fluid membrane/array) for air-filtration and separation of water/oil droplets or as obstacles for separation of particles in fluid. The use of anchored liquid arrays submerged in an immiscible continuous phase as a novel type of stationary phase in a DLD or other filtration system has not been explored before.

Various embodiments provide a deterministic lateral displacement (DLD) system in which the standard array of cylindrical posts is replaced by a lattice of anchored liquid-bridges (e.g., water or other liquid). The water bridges are created between two parallel plates and anchored to the bottom one by means of a square array of cylindrical wells. The anchored water-bridges are stable when vertically submerged in an immiscible liquid environment. They also maintain their stability as particles of various sizes and densities move through the array. Anchored-liquid DLD arrays lead to size-based separation of suspended particles. In various embodiments, liquid-bridge deformation leads to separation by density. In various embodiments, the advantages of liquid-based arrays are their possible extension into filtration systems.

While the various embodiments are generally discussed as including an array of "wells" or "holes" or "through holes" and the like, it will be understood by those skilled in the art that other types of anchoring structures may be used. Further, in various embodiments, the structure of the wells and/or through-holes is adapted in size, shape and the like in response to the type of anchored-liquid used (water, oil, various solutions and the like; high/low wetting, drop contact angle and the like), the desired size of the anchored-liquid drop or pillar and other design goals. In various embodiments, chemical patches and/or patterns are used as anchoring structures either alone or in conjunctions with one or more of wells, holes, through holes and the like. For example, a pattern (e.g., circular or other shape) on a surface may interact with the liquid to stay/wet the liquid with respect to that surface shape (deposition) such that an anchoring-liquid drop tends to maintain a position and effectively adhere to that portion of the surface.

In various embodiments, the amount of wetting (i.e., high, low or somewhere in between) is selected to provide a desired shape such as to ensure a substantially cylindrical anchored-liquid column, a slightly concave anchored-liquid column, a slightly convex anchored-liquid column and so on as desired. As will be discussed below with respect to anchored-air column embodiments, the shape of an anchored-air column may also be adapted by controlling the amount of wetting associated with the anchored-air column anchor points and/or the regions surrounding/proximate such anchor points.

Various embodiments extend DLD systems by utilizing an array of anchored liquid bridges. By changing the traditionally solid obstacle into liquid ones, various embodiments can deal with the clogging issues that exist in traditional DLD systems in a more effective and convenient way, that is, simply flushing out the clogged system and remake a new liquid obstacle array. In fact, instead of using an array of wells, various embodiments use a lattice of through holes to anchor the liquid bridges so that various embodiments can regenerate the lattice more conveniently. Another advantage of using through holes as anchors is that various embodiments can potentially vary the size of the obstacle by controlling the liquid volume injected through, which, in turn, will make the DLD system tunable and fit for multiple uses. In addition, by utilizing an array of deformable liquid obstacles, various embodiments may separate particles by other characteristics beside size, for instance, density. Moreover, by employing a two phase complex fluid system, various embodiments may extend the function of the DLD systems from separation to potentially filtration or other applications, which could enormously broaden the possibility of the DLD system.

FIG. 1 depicts several views of an anchored-liquid array in accordance with various embodiments. Specifically, FIG. 1*a* and FIG. 1*b* depict different views of an anchored-liquid array embodiment without the top plate. FIG. 1*c* depicts an embodiment comprising a plurality of liquid bridges with the top plate. FIG. 1*d* depicts an image of an experimental set-up showing the trajectory of 0.79 mm and 1 mm particles when a forcing angle $\alpha$=17°. It can be seen by inspection that the 1 mm particles (rightmost circles) are moving in a locked mode, that is, they are locked in the [0,1] direction, and 0.79 mm particles (leftmost circles) are locked in the [1,3] direction.

Experimental Setup and Characteristic Parameters

Figure 1B:
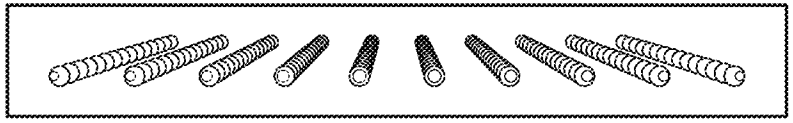
Figure 1C:
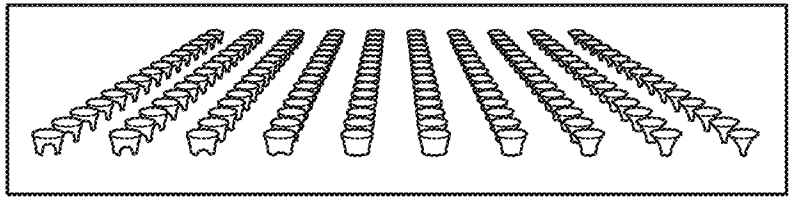

A force driven macroscopic set up is used wherein the diameter of the posts and particles in millimeter scale so as to make array manipulation and particle motion monitoring easier. To form the lattice of anchored liquid bridges, various embodiments first create an array of wells on a coated polypropylene plate. The spacing between two neighboring wells is l=6 mm and the diameter of the posts is taken as the diameter of the wells, that is D=1.78 mm. Then, water droplet of uniform volume are deposited into each well using a syringe pump as shown in FIG. 1*a*-1*b*. The paint (Rust-Oleum NeverWet multipurpose kit) used on the polypropylene plate renders the surface to be super-hydrophobic and is key to maintain the uniform spacing between drops and to anchor the water droplets in the wells. To create the liquid bridges, an acrylic plate is then placed on top of the array with a certain gap distance h and the final lattice is demonstrated in FIG. 1*c*. Various embodiments maintain a low Reynolds number environment in the setup so that the results can be compared to that obtained in microscale by submerging the lattice in corn oil with viscosity $\mu$=52.3 mPa·s and density $\rho_f$=0.926 g/cm$^3$. Various experiments used a=0.79 mm (Mcmaster-Carr) and 1 mm (Precision Plastic Ball Co.) particles of different materials and the characteristics of which are listed in Table 1 (along with a calculation for particle Reynolds number and stokes number). Various embodiments also listed particle Reynolds number calculated by $$Re_p = \frac{2\rho_f U a}{\mu}, \text{ where } U = \frac{2(\rho_p - \rho_f)ga^2}{9\mu},$$

Stokes number calculated from equation $$St = \frac{1}{9}\left(\frac{\rho_p}{\rho_f}\right)Re_p$$

in order to evaluate the inertial effect. It is noted that the particle Reynolds number is of order 1 in the exemplary system, especially for the larger particles with higher density, which, as a result means that the particle inertial effect cannot be ignored in the proposed system. To evaluate the deformation of liquid obstacles in the proposed system, it is possible to calculate the capillary number with equation $$Ca = \frac{\mu U}{\sigma}$$

where $\sigma$ is estimated to be 23 mN/m and U is taken as the particle settling velocity.

TABLE 1

| Particle radius a (mm) | Material | Particle density $\rho_p$ (g/cm$^3$) | Reynolds number Re | Stokes number St | Capillary number Ca |
|---|---|---|---|---|---|
| 0.79 | Nylon | 1.140 | 0.156 | 0.021 | 0.013 |
| 0.79 | Acrylic | 1.185 | 0.188 | 0.027 | 0.015 |
| 0.79 | Delrin | 1.410 | 0.352 | 0.060 | 0.029 |
| 0.79 | Teflon | 2.200 | 0.927 | 0.245 | 0.075 |
| 1 | Nylon | 1.140 | 0.316 | 0.043 | 0.020 |
| 1 | Acrylic | 1.185 | 0.382 | 0.054 | 0.025 |
| 1 | Delrin | 1.410 | 0.714 | 0.121 | 0.046 |
| 1 | Teflon | 2.200 | 1.880 | 0.496 | 0.121 |
| 1 | Glass | 2.500 | 2.323 | 0.697 | 0.149 |

Figure 1D:
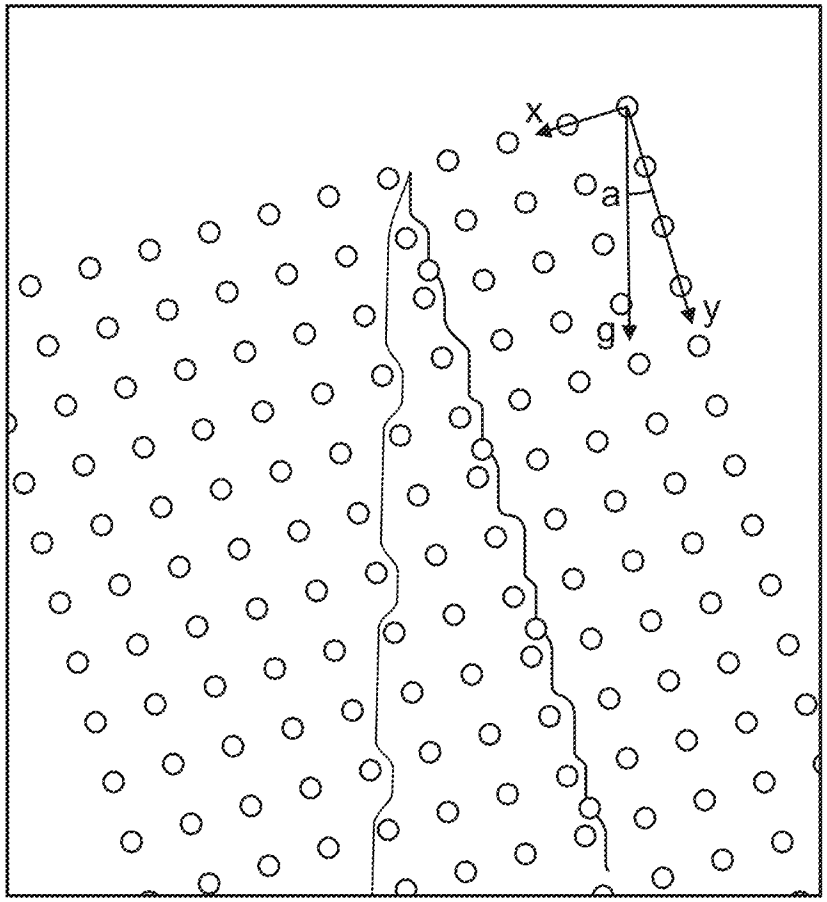

Referring to FIG. 1*d*, analogous to traditional DLD systems, the angle between the force (gravity) and the orientation of the post (y axis) is defined herein as forcing angle $\alpha$. Migration angle $\beta$ is defined as the angle between the particle migration direction and the orientation of the posts (y axis). Various embodiments vary the forcing angle continuously within the range of 9°-23° during the experiment process for particles of each size and material, and various embodiments monitor the particle trajectories in each forcing angle with a video camera. For each trail, various embodiments may use 20-25 particles and the migration angle is taken as the average migration angle of all the particles used.

Experimental Results and Discussion

Sharp Mode Transition: Crossing Probability $P_c$

Figure 2:
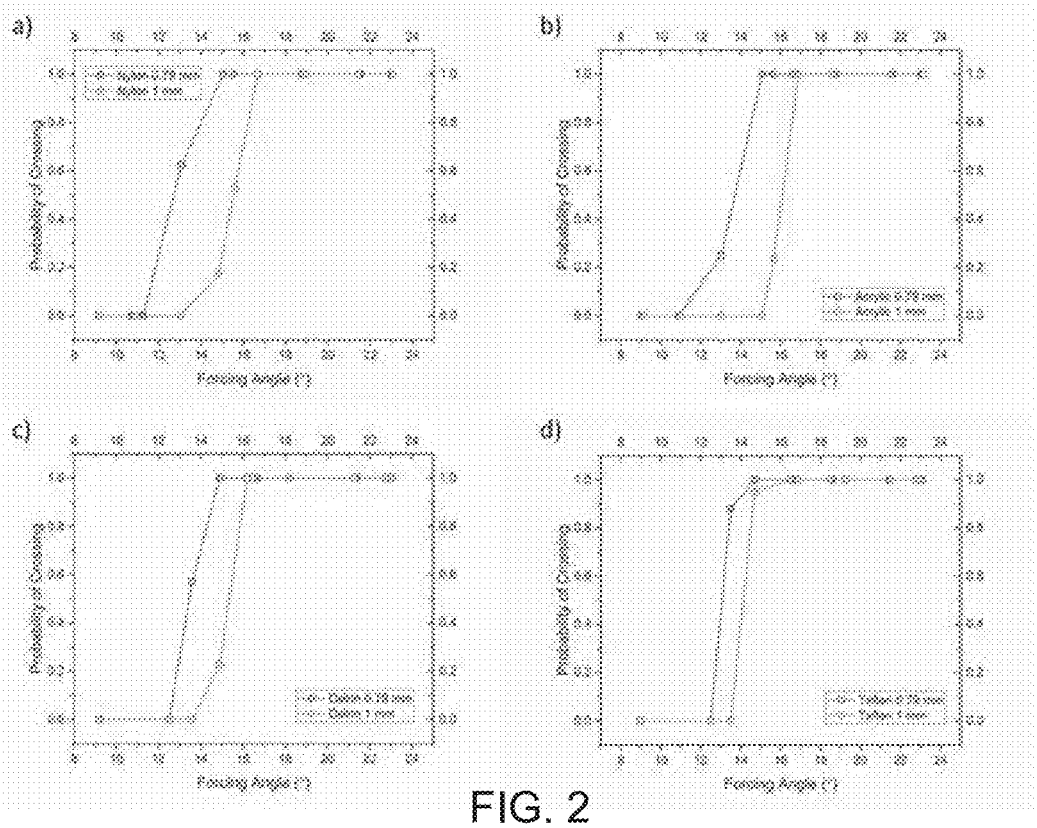
FIG. 2(*a*)-2(*d*) depicts graphical representations of probability of crossing (Pc) as a function of forcing angle for several materials.

FIG. 2 depicts graphical representations of probability of crossing (Pc) as a function of forcing angle for several materials; namely, Nylon particles (FIG. 2*a*), Acrylic particles (FIG. 2*b*), Delrin particles (FIG. 2*c*) and Teflon particles (FIG. 2*d*). It can be seen by inspection that at Pc=0, all particles are locked by the post direction; at Pc=1, all particles zigzag inside the array; and at Pc=0.5. the critical angle is reached.

For a certain size of particle, it is observed that particle will stay in locked mode when the forcing angles are smaller than a critical value. However, particles will transition into zigzag mode right after the forcing angle is larger than that critical value. To quantitatively characterize the transitional behavior for different particles, define probability of crossing $P_c$. as the ratio between the number of particles that zigzag inside the lattice with respect to the total number of particles used in one single trial and plot it as a function of forcing angle as shown in FIG. 2. By definition, in a single trial, $P_c=0$ represents the situation that all the particles are locked by the post direction; $P_c=1$ represents the situation that all the particles zigzag inside the lattice; and if particles are moving in both modes in a single trial, then $0<P_c<1$. Thus is defined the critical angle $\alpha_c$ as the forcing angle when $P_c=0.5$. In this plot, it can be seen by inspection that for particles of the same material, critical angle increases with the particle size, which is in consistency with that observed in traditional DLD systems. In other words, particles can still be separated based on the size difference in the proposed system.

Directional Locking

Figure 3:
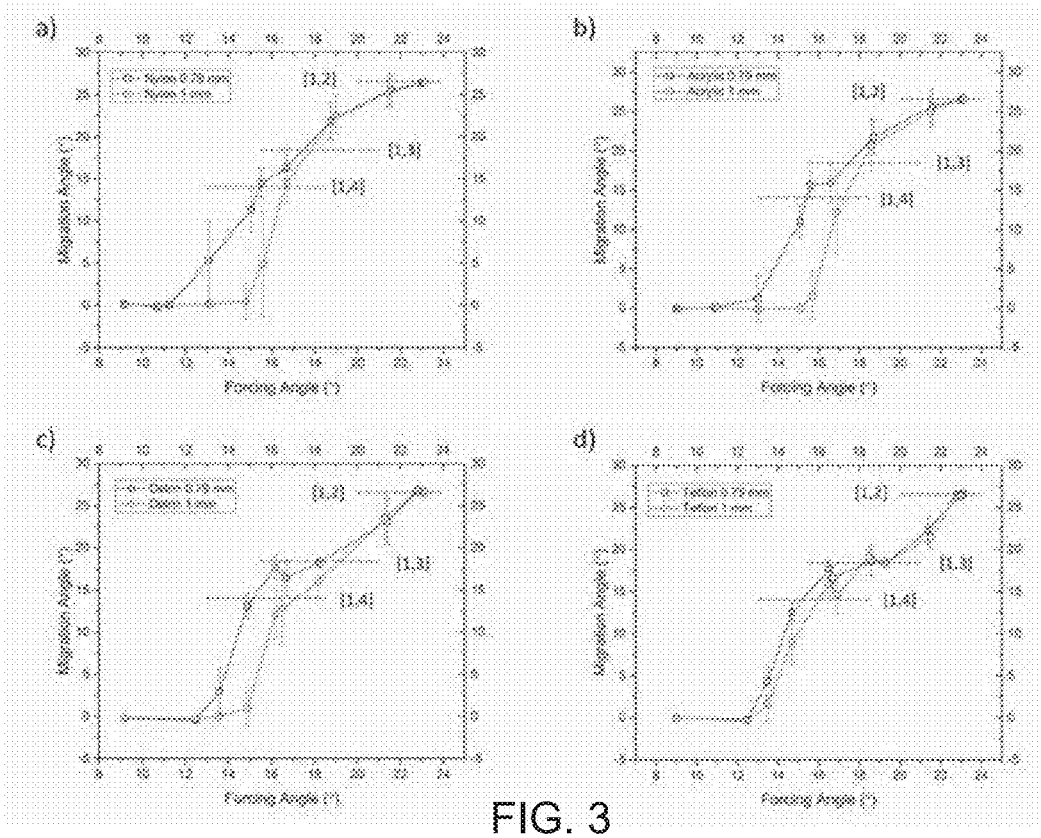
FIG. 3(*a*)-3(*d*) depicts graphical representations of average migration angle as a function of forcing angle for several materials.

FIG. 3 depicts graphical representations of particle average migration angle as a function of forcing angle for several materials; namely Nylon (FIG. 3*a*), Acrylic (FIG. 3*b*), Delrin (FIG. 3*c*) and Teflon (FIG. 3*d*) particles. By definition, particles have a zero migration angle when all the particles in a single trial move in locked mode. When some of the particles start to move in zigzag mode, however, the average migration angle becomes non-zero. Based on the results, one can clearly observe that for Nylon, Acrylic and Delrin particles, there exists a certain range of critical angle that the 0.79 mm particles and 1 mm particles can be separated. However, as shown in FIG. 3*d*, the two different size of Teflon particles have very similar motion patterns and could not be easily separated by the proposed system. The horizontal dot dashed lines represent the migration angle when particle are locked in certain lattice direction. In the traditional DLD systems that when particles zigzag inside the obstacle array, they move in a locked lattice direction in a range of forcing angles, which is defined as "directional locking". As a result, there are plateaus shown in FIG. 3 where migration angle is plotted as a function of forcing angle that match with the dot-dashed lines as shown in FIG. 3. However, based on the results obtained in the proposed system, the directional locking phenomenon is not observed as clearly as in the traditional DLD systems.

Density Effect: Inertia

Figure 4:
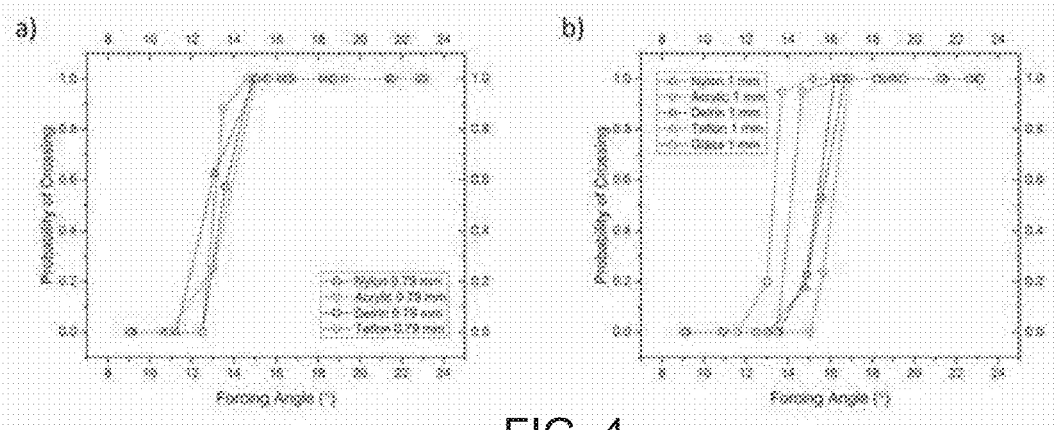
FIG. 4(*a*)-4(*b*) depicts graphical representations of probability of crossing as a function of forcing angle.

FIG. 4 depicts graphical representations of probability of crossing as a function of forcing angle. Specifically, FIG. 4*a* depicts 0.79 mm particles with different materials, while FIG. 4*b* depicts 1 mm particles with different materials.

Figure 5:
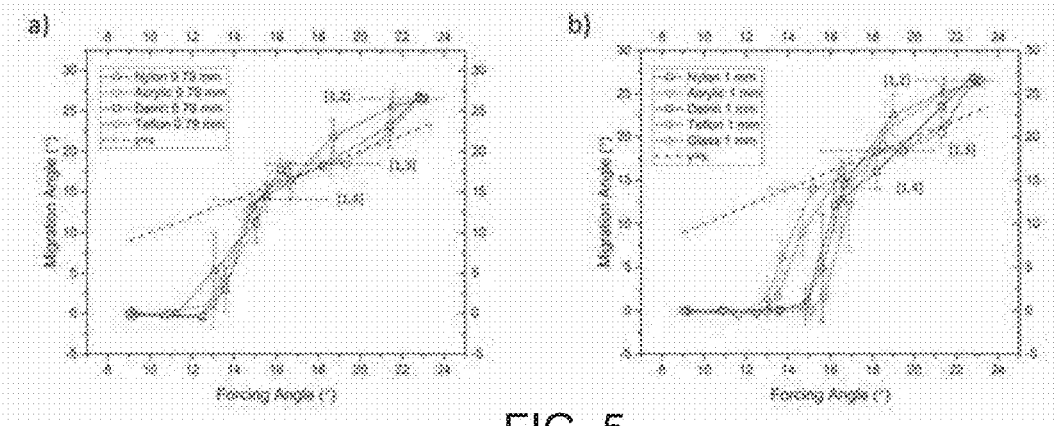
FIG. 5(*a*)-5(*b*) depicts graphical representations of average migration angle as a function of forcing angle.

FIG. 5 depicts graphical representations of average migration angle as a function of forcing angle. Specifically, FIG. 5*a* depicts 0.79 mm particles with different materials, while FIG. 5*b* depicts 1 mm particles with different materials. The dashed lines in both plots represent the line y=x which represent the cases where particle move in the direction of the driving force (e.g., gravity).

It is useful to combine the data for the same size of particles with different materials as shown in FIG. 4 and FIG. 5, such that it can be seen that for 0.79 mm particles, different material particles all have similar critical angle and motion pattern because all the crossing probability curves and migration angle curves seem to collapse into one. However, for 1 mm particles, Teflon particles and glass particles have substantially smaller critical angles while the particles of three other materials seem to have similar critical angles. In particular, various embodiments can separate particle with higher density such as Teflon and glass particles from the less dense particles when the forcing angle falls in the range of ~14°-15°. Although further study is required to reach a concrete conclusion, based on the calculation of the Reynolds number and the capillary number, the particle inertial effect and/or the particle deformation could contribute to the critical angle difference between 1 mm particles with different material.

Figure 6:
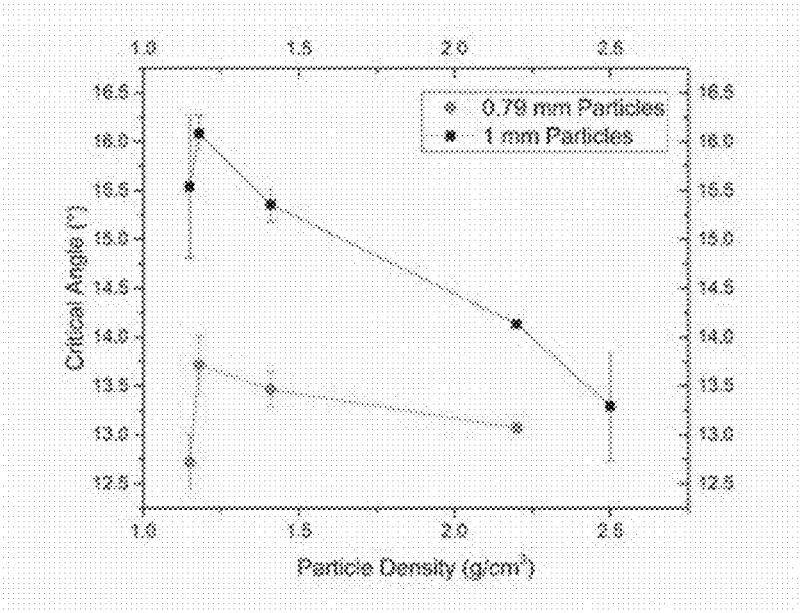
FIG. 6 depicts a graphical representation of particle critical offset plotted as a function of particle density.

FIG. 6 depicts a graphical representation of particle critical offset plotted as a function of particle density. Specifically, it is noted that when the particle density is high enough, the critical angle deceases drastically as the Reynolds number increases, which could compromise the size separation function for the proposed DLD system. Moreover, compared with the solid obstacle case[14], the anchored-liquid DLD systems appear to be more sensitive to particle inertia. In particular, the size separation still exists for particles with St up to ~28 in the gravity driven solid obstacle system, while in comparison, considering Teflon particles (St 0.25 and 0.5 for 0.79 mm and 1 mm particles respectively) used in the experiments, the difference in critical angle for two different size of particles is already relatively small. Other than particle inertia, another reason for the decrease in the critical angle for particle of different materials could be the increased obstacle deformation. Specifically, it is observed that as the particle density increases, the liquid bridges that the particles encounter are more severely deformed which is also validated by the calculation of capillary numbers.

Thus, a novel gravity driven deterministic lateral displacement system with an array of anchored-liquid bridges is provided. Various embodiments explore the motion pattern for two different size particles of various materials in the system and prove that the size separation function shared by traditional deterministic lateral displacement still exists in the proposed system. In particular, various embodiments can separate particles that have as little as 20% difference in size. Additionally, it is observed that if particle density is high enough, the critical angle decreases with particle density. Given that particle Reynolds number and the obstacle capillary number both increase with the particle density. The decrease in the critical angle could be due to either the increase of particle inertia or the increase in obstacle deformation, or both. Note that the proposed DLD system is comprised of an array of interfaces, which could be better exploited in other applications, for example, an air filtration system. Theoretically, extremely small pollutants in air could be attracted to the air-water interfaces when moving through the lattice of liquid bridges and as a result, the proposed system could function as an air purification unit.

Various modifications to the above-described embodiments are also contemplated by the inventors, including those disclosed below.

The various embodiments described herein find technical utility within the context of a wide range of, illustratively, chemical and biological separations by utilizing anchored-fluids, arranged in periodic structures, as stationary-phase and/or filter media. The use of periodic arrays of anchored-fluid elements submerged in an immiscible continuous phase would be a novel and promising type of stationary phase. Various embodiments take advantage of the unique properties of a fluid stationary phase, for example, to capture particles that would preferentially go to the mobile-fluid/anchored-fluid interface.

Various embodiments find applicable to the in a number of areas/applications such as implementing DLD devices with liquid posts, providing anchored-water air-filtration devices, and providing supercoalescers for the separation of water/oil emulsions, using anchored-fluid bridges that are directly connected to a secondary channel. Within the context of anchored-water air-filtration devices, in addition to the preference of particles to go to the air-water interface, these devices may take advantage of the presence of attractor trajectories to create highly efficient filters. In various embodiments these water-based filters our continuously cleaned during operation, such as by cross-flowing the stationary phase, much like mucus clearance protects mammalian airways. Within the context of supercoalescers for the separation of water/oil emulsions, the presence of attractor trajectories may be used to improve coalescence efficiency.

In various embodiments, models predict anchor strength depending on fluids properties, wettability of channel and anchor material and geometric configurations. The models also contemplate scale dependence and validate results in meso/micromodels. Specifically, depending on fluids and solid properties (viscosity contrast, surface tension, contact angle), anchoring geometry (chemical patches, shallow wells, connecting-holes, pillars) and working conditions (Reynolds number, capillary number), anchored-fluid elements can sustain significant flow rates and viscous stresses without detaching or breaking. In this manner, specific wealth structures and/or anchor strengths may be selected depending upon application, species/particles to be separated/filtered, preferred materials and the like. The inventors note that the release (or breaking) of anchor-fluid array droplets, anchored in shallow wells, requires significant flow rates. Further, anchored-fluid elements, such as droplets and liquid columns, can easily sustain relatively large fluid velocities.

Various embodiments use anchored-fluid arrays to create fluid-based membranes and stationary phases for a new generation of filtration and separation devices spanning multiple length scales and impacting a wide-range of applications. Various applications include applications at different scales, from standard bio-separations in microfluidic DLD devices (microscale), to the filtration of airborne particulate matter (micro/mesoscale), to wastewater treatment and oil-water separation (mesoscale).

In various embodiments, anchored-fluid elements are arranged in periodic arrays to provide stationary-phases with various properties suitable for new applications, including the extension of Deterministic Lateral Displacement separation using liquid-pillars, the inertial filtration of airborne particles using anchored-fluid bridges and the treatment of water-oil emulsions with water/oil anchored-fluid arrays.

Various embodiments using anchored-fluid elements are applicable larger scale applications, such as membrane applications that rely on the contact between immiscible fluids. For example, instead of hollow fiber contactors various embodiments maximize the contact area between the two immiscible phases by having an array of liquid bridges, with a design to enable cross-flow. Similarly, multiphase separations relaying on sedimentation or floatation methods May also be implemented using anchored-fluid elements.

The inventors note that depending on fluids and solid properties (viscosity contrast, surface tension, contact angle), anchoring geometry (chemical patches, shallow wells, through holes, pillars) and working conditions (Reynolds number, capillary number) fluid elements can sustain significant flow rates without detaching or breaking.

Various embodiments use immobilized or anchored-fluid drops or columns/bridges working as the stationary phase or membrane material. Such immobile liquid elements can sustain significant crossflow and/or pressure drop. The competition between adhesion forces and surface tension trying to maintain the drops position and shape with the shear forces trying to remove or mobilize them is captured by the dimensionless capillary number, $$Ca = \frac{\mu U}{\gamma}, \quad \text{(eq. 1)}$$

where μ is the viscosity of the continuous phase, U is the characteristic velocity of the flow and γ is the surface tension between the drop and the outer fluid (continuous phase).

Figure 7:
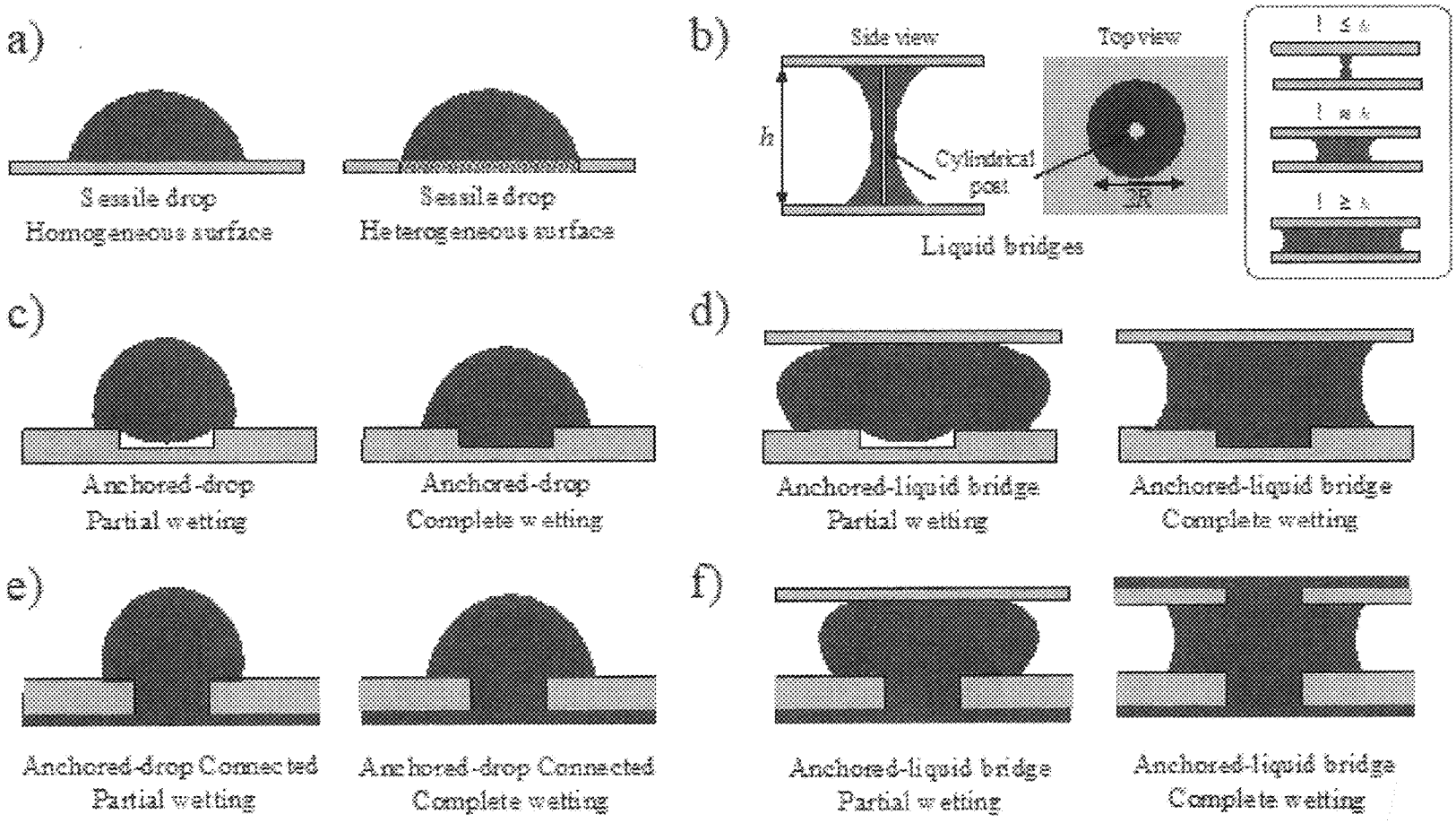
FIG. 7(*a*)-7(*f*) depicts graphical representations of several different anchored-fluid configurations suitable for use in anchored-liquid arrays according to the various embodiments.

FIG. 7 depicts graphical representations of several different anchored-fluid configurations suitable for use in anchored-liquid arrays according to the various embodiments. In particular, the various anchored-fluid configurations depicted in FIG. 7 may be used in a number of different use cases or applications as the building or individual array elements of the stationary phases. The depicted configurations range from simple sessile drops deposited on homogeneous solid surfaces, to liquid-bridges that are not only anchored but connected to a reservoir/channel of the same fluid. In each case there exists a critical capillary number Ca*, and other dimensionless numbers, such as the Reynolds number if inertia effects are important, and different aspect ratios describing the specific geometry of the fluid elements and flow field (e.g., note the different aspect ratios in FIG. 7*b* between anchored-fluid bridge radius and channel height).

Sessile drops or bubbles: The first case, that of sessile drops deposited on a surface in the presence of flow (FIG. 7*a*) has been studied in some detail. First of all, it is important to note that the ability of drops to adhere to a solid surface depends on the hysteresis of the contact angle. In this sense, the case with a heterogeneous surface (FIG. 7*a*, heterogeneous), for example with patches on which the contact line is pinned, will be able to sustain larger flow rates. In any case, experimental results have shown that, even in the case of homogeneous surfaces, Ca*~0(10-3) or larger, for a number of different liquids (see Table 2). The associated flow velocities show a wide range, from centimeters to several meters per second, suggesting that sessile drops might in fact be strong enough in many cases.

Under analysis, the inventors used a multiphase Lattice-Boltzmann code as discussed in the Methods section below. Initially considering that the contact line is completely pinned and compare LB with standard finite element methods for validation. Then slowly increasing the flow field until one of the following things happen: (i) the drop becomes unstable, (ii) the drop deforms significantly (for example, using a deformation parameter and setting a threshold value, (iii) the drop moves or (iv) unphysical contact angles are obtained. This will provide the basis for comparing results obtained numerically and experimentally in more complex geometries.

TABLE 2

| Type | Drop fluid | Continuous phase | Contact radius | Height | Solid surface | Ca* | U [m/s] |
|---|---|---|---|---|---|---|---|
| a | Alkane (Pristane) | Water | 20-150 μm | Large | glass | 0.001 | 0.05 |
| a | Oil | Water | 1.5-5 mm | Large | Stainless steel | ~0.01 | 0.5 |
| a | Oil (Aniline) | Water | 1-3 mm | Large | Silica glass | 0.01† | 0.5 |
| a | Oil (Isoquinoline) | Water | 1-3 mm | Large | Silica glass | 0.1† | 5 |
| a | Water | Air | 1-3 mm † | Large | Silane | 0.002 † | 7-12 |
| a | Water/Glycerine | | | | treated | 0.002 † | 8-14 |
| a | Glycerine | | | | glass | 0.003 † | 10-15 |
| b | Viscosity ratio = 1 | | 1 | 1.7 | | ~0.1 | |
| b | Air | Oil | ~3-300 μm | 34 μm | Dip- | 0.0004 | $4 \times 10^{-5}$ |
| | | | ~6-600 μm | 60 μm | coated | 0.001 | $10^{-4}$ |
| | | | ~10-1000 μm | 122 μm | Glass | 0.002 | $2 \times 10^{-4}$ |
| | | | ~20-2000 μm | 164 μm | (hydro- | 0.003 | $3 \times 10^{-4}$ |
| | | | | | phobic) | | |
| c | Water | Air | 1.5-3 mm † | Large | Copper | 0.003† | 10-15 |
| d | Water | Oil | ~600 μm | 20-60 μm | PDMS | 0.002 | ~0.05 |

Liquid-Bridges: This case, represented in FIG. 7*b*, has been studied experimentally for the case of a bubble in a slit microchannel (the vertical motion of the surfaces has been studied extensively due to its interest in contact printing). Table 2 discloses values for the case of a bubble immersed in oil. It is noted that the numerical results are quite encouraging, showing large values of the critical capillary number. In addition, they report little variation with the channel height-to-bridge diameter ratio or the viscosity contrast between the bridge and the surrounding fluids. It is also noted that the critical capillary numbers reported in the only experimental work are significantly smaller. LB simulations are performed assuming complete pinning of the contact line, which provide a baseline for the anchored cases. One extension is liquid bridges that have a pillar as anchor. The related problem of a cylinder coated with a viscous film in the presence of a cross-flow has been considered, such as in the case of a thin film. With respect to the critical capillary number for breakup in this case fabrication may be implemented based on, illustratively, displacing a wetting fluid by a non-wetting one (see fabrication discussion and displacement method, which provides a stable of anchored-fluid elements.

The inventors provide a combined numerical and experimental approach to characterize the behavior of anchored-drops and anchored-fluid bridges in cross-flow. Specifically, these types of fluid elements (such as per FIG. 7*c* and FIG. 7*d*) can sustain significantly larger cross-flow velocities and viscous shear stress, possibly reaching thousands of microns per second in a microscale channel (see Table 2). One particularly interesting case, is that of micro-grooved surfaces, equivalent to multiple anchoring slots for a single drop. Recent experimental work on air flow dislodging a drop of water from a micro-grooved surface reported critical velocities in the range of 10 m/s (see Table 2).

Figure 8:
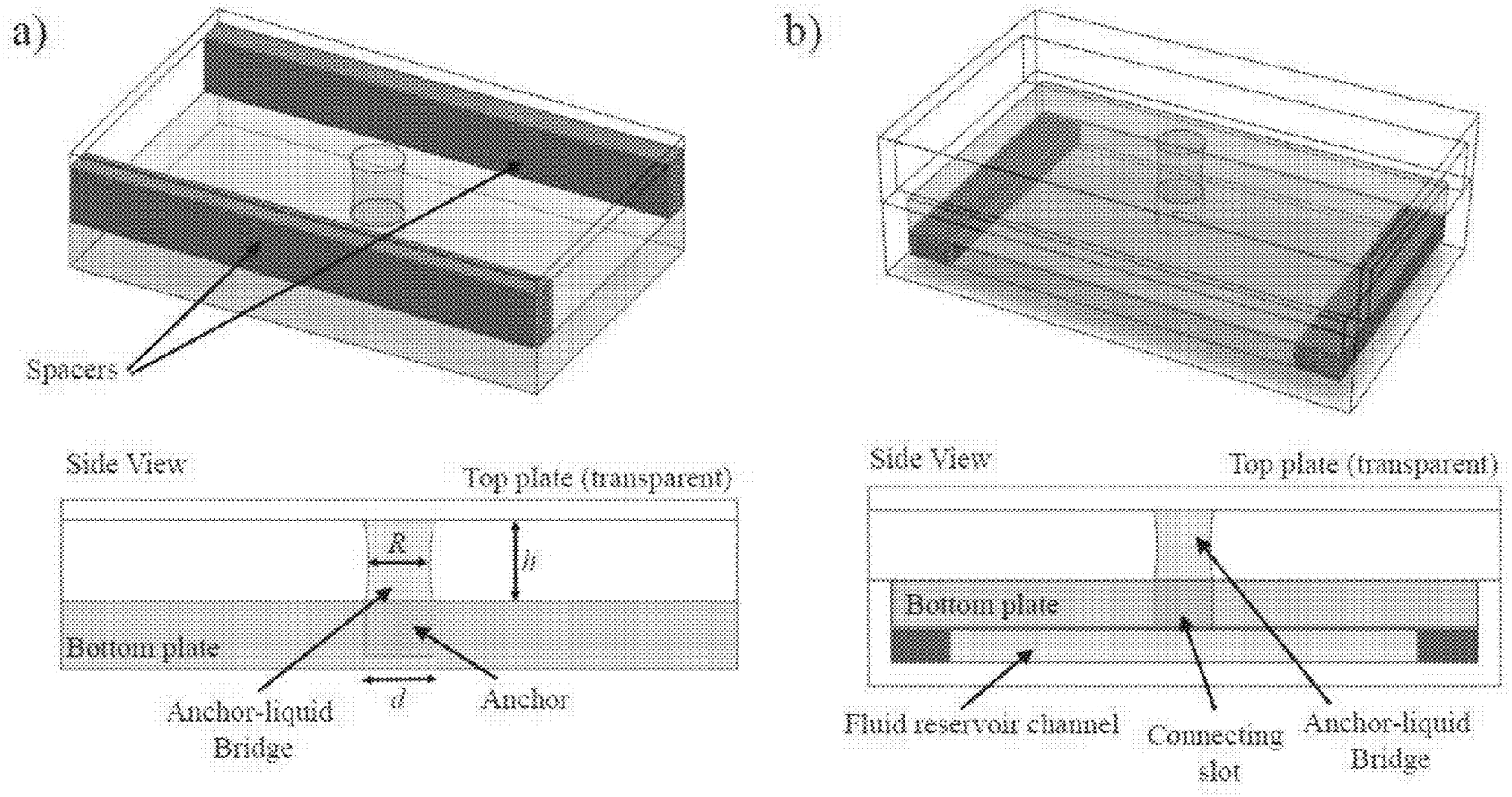
FIG. 8(*a*)-8(*b*) depicts a testing section of an experimental setup for examining the structure of an individual anchored-drop/liquid-bridge element.

FIG. 8 depicts a testing section of an experimental setup for examining the structure of an individual anchored-drop/liquid-bridge element. Specifically, FIG. 8*a* depicts examples of anchored-drops and liquid-bridges, while FIG. 8*b* depicts examples of anchored-fluid elements being connected to a reservoir of the same fluid.

The inventors combined LB numerical simulations and mesoscale model experiments to investigate the behavior of anchored-drops and liquid-bridges in the presence of flow. In particular considering air, water and oil as the possible continuum and drop media. The schematic of the testing channel is shown in FIG. 8*a*.

In all cases, determining the critical conditions leading to drop detachment or breakage and compare with the results obtained in the numerical simulations; specifically, determining the dependence of the critical capillary number Ca* on confinement (h/R) and relative anchor size (d/R), see FIG. 8*a*.

Fabrication of mesoscale models and microfluidic systems for separation and filtration experiments with suspended particles. Specifically, the anchored-fluid elements can be arranged in periodic arrays to provide stationary-phases with novel and promising properties for separation and filtration applications. This includes anchored-fluid arrays (mesoscale models and microdevices) validating Ca* values in liquid-liquid systems, anchored-water arrays systems validating Ca* in gas-liquid systems, and anchored-water and anchored-oil connected systems validating Ca*. Generally speaking, the various embodiments provide a method of fabricating meso/microfluidic devices having anchored-droplet arrays and test the flow rates leading to detachment or breakup. For sufficiently separated anchored-elements, the results validate the simulation approach and confirm the scaling investigation, as the LB method is tested at the mesoscale and validated at the microscale as well. Critical capillary number as a function of the orientation of the array with respect to the flow are also considered, although at low Reynolds numbers there is no expectation of differences, in the case of air-flow and for the mesoscale scale coalescing device, the presence of wakes behind the anchored-fluid elements could have a significant effect.

Various embodiments support these applications such as by including the extension of Deterministic Lateral Displacement separation using liquid-pillars, the inertial filtration of airborne particles using anchored-fluid bridges and the treatment/separation of water-oil mixtures with water/oil anchored-fluid arrays. In various embodiments, the liquid stationary-phase is used to enable separation/filtration methods.

Various embodiments use anchored-drop arrays as the stationary-phase in deterministic lateral displacement microfluidic separation devices.

FIG. 9 depicts an exemplary anchored-fluid array as well as operational details associated with an exemplary anchored-liquid array in accordance with various embodiments.

Figure 9B:
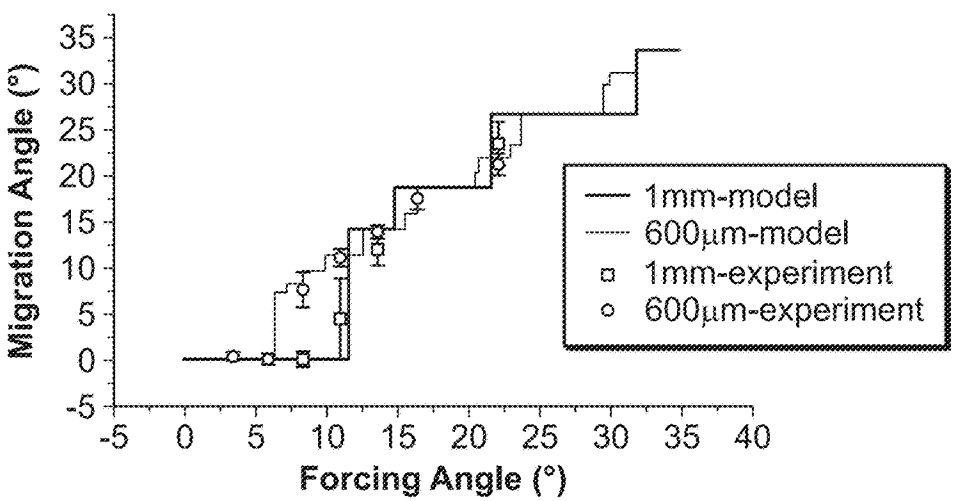
FIG. 9(*a*)-9(*d*) depicts an exemplary anchored-fluid array as well as operational details associated with an exemplary anchored-liquid array in accordance with various embodiments.
Figure 9D:
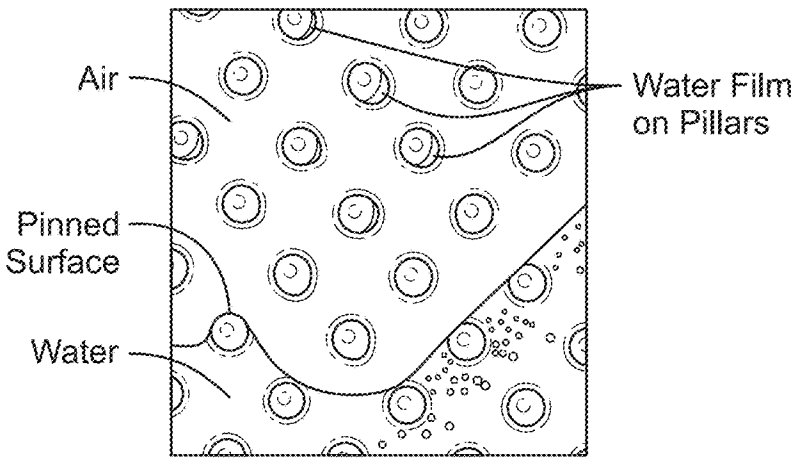
Figure 9A:
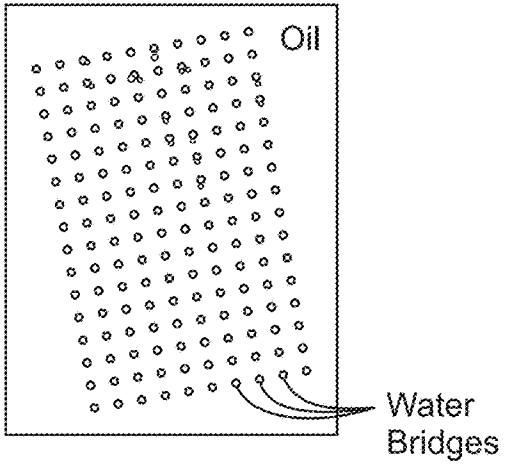

FIG. 9*a* depicts an exemplary array with anchored-drops of water of approximately 2 μL submerged within an immiscible liquid (illustratively oil) within the context of a gravity-driven DLD.

FIG. 9*b* depicts results of DLD experiments of the array of FIG. 9*a*, showing an ability of the array to separate 1 mm particles from 0.6 mm particles, as well as the presence of directional locking and vector separation. The results are depicted as a graphical representation of migration angle as a function of forcing angle for 1 mm and 0.6 mm particles. Separation drivers may be gravity as tested, as well as other types of flow as discussed herein.

Figure 9C:
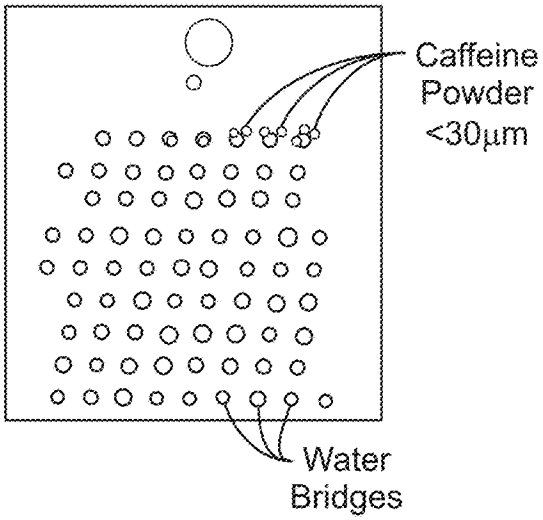

FIG. 9*c* depicts an experimental setup showing the filtration of caffeine powder using an array of anchored-water liquid-bridges. It is noted that the first (top) row of water elements clearly shows the attachment and reaction of caffeine powder into the individual anchored-water liquid-bridges forming that row.

FIG. 9*d* depicts an image showing that after air displaces water from a traditional pillar array, it is clear that water is left behind in the form of films coating the cylindrical pillars, forming thereby the elements described above with respect to FIG. 7*b*.

For gravity-driven DLD separation, depending on the surface properties of the particles and the corresponding contact angle with water, their interaction with the anchored-water liquid bridges may be significantly different and in accordance with a new separative property. Specific angles, aligned with the intrinsic locking directions of the array, may lead to particle capture, depending on particle properties.

For flow-driven DLD separation, a flow driven DLD system for suspended particles using anchored-water drops immersed in oil in mesoscale models and in microdevices provides separation and possible capture depending on the forcing direction and material of the particles.

Anchored-water stationary-phase for filtration of airborne particulate matter. Various embodiments of anchored-water array, as shown in FIG. 9*c*, are capable of separating and retaining particles smaller than 30 μm from a cross-flow of air. In FIG. 4*c* it can be seen that the powder is retained in the first line of anchored-water elements. Also, an alternative configuration is shown in FIG. 9*d*, in which a channel contains an array of micro-pillars with water and then the water was displaced with air. As a result, a water film is left behind coating the pillars. This type of configuration (e.g., as shown in FIG. 7*b*) provides a stable type of anchored-fluid element.

As previously noted, directional locking, critical slowdown and enhanced capture have been demonstrated by the inventors. There exists common dynamics in a wide range of cases, including different driving forces (gravity, electric field, flow, centrifugal force) and length scales (mesoscale models, micro/nanodevices). The typical behavior of the migration angle as a function of the forcing angle is that presented in FIG. 9*b*, and shows clear 'plateaus' in the migration angle vs. forcing angle curves, indicating a constant migration angle for finite intervals of the forcing angle. This phenomenon is denoted as directional locking, and only some migration angles are possible, which coincide with lattice directions in the array of obstacles.

Figure 10A:
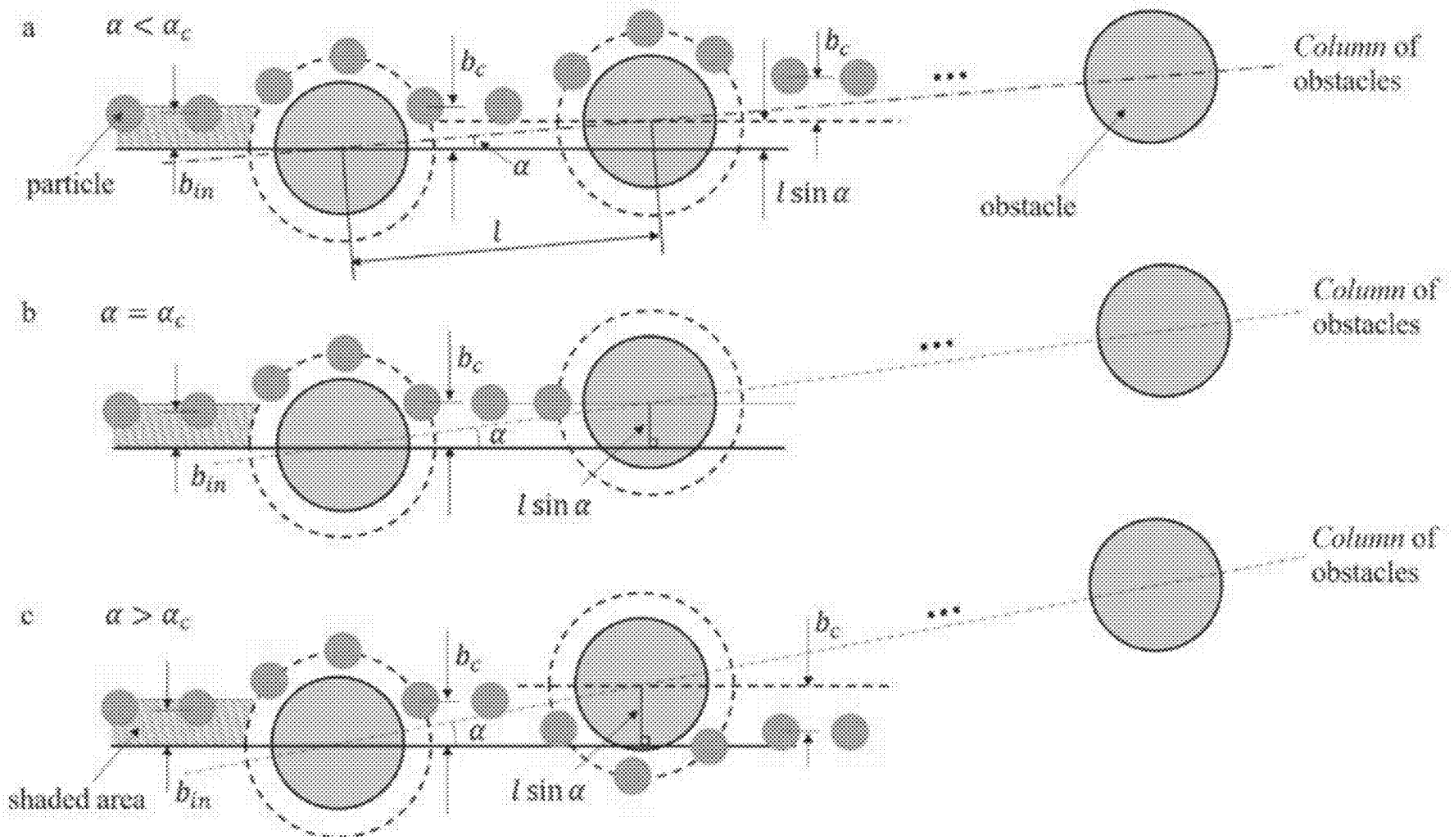
FIG. 10A(a)-10A(c) depicts a schematic representation of a first critical transition in the motion of suspended particles through an array of obstacles.
Figure 10B:
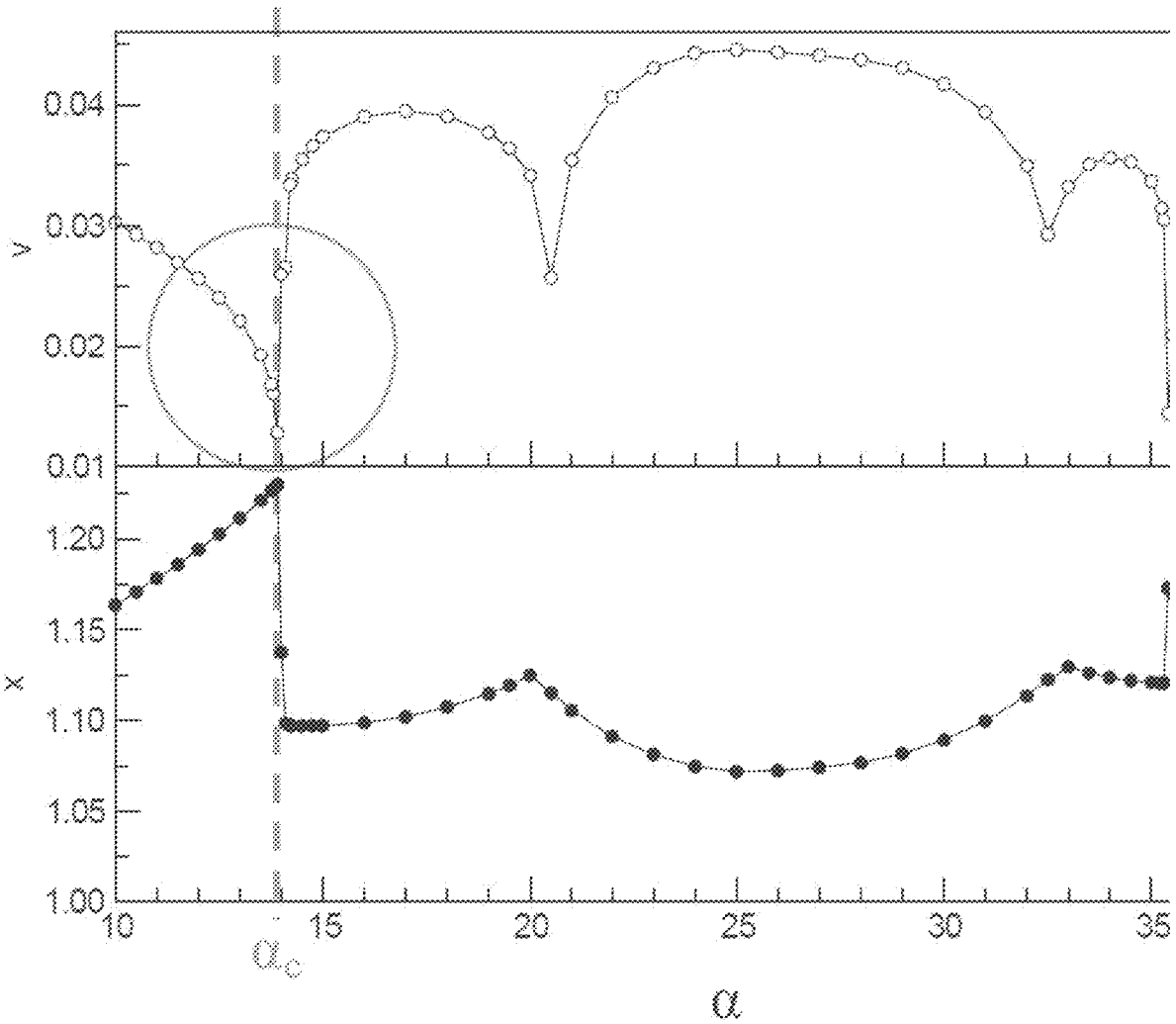
FIG. 10B depicts a graphical representation of particle velocity plotted as a function of forcing angle.

FIG. 10A depicts a schematic representation of a first critical transition in the motion of suspended particles through an array of obstacles. FIG. 10B depicts a graphical representation of particle velocity plotted as a function of forcing angle and, in particular, illustrating the critical slowdown occurring at the critical angle. FIG. 10A and FIG. 10B will be discussed together.

FIG. 10A shows the behavior around the first transition in the locking directions at the critical forcing angle αc. It can be seen by inspection that at small forcing angles, the particles are locked to move along a single lane in the array as shown in FIG. 10A-a. Then, at the critical angle $\alpha_c$, the particles coming out of a collision hit the next obstacle head on as shown in FIG. 10A-b. At larger forcing angles, a particle is able to move around the obstacle and change "lanes" in the array as shown in FIG. 10A-c. Of particular interest is that around the critical angle there is a significant slowdown of the particles; that is, their average velocities are reduced significantly, as shown in FIG. 10B. This slowdown is merrily due to the head-on type of collision experience but particles that occurs at the critical forcing angle.

Generally speaking, close to the critical orientation of the device a significant enhancement of particle capture due to this slowdown effect occurs. In addition, the locking trajectories act as irreversible attractors and all trajectories collapse into the ones that lead to enhanced capture.

Figure 11A:
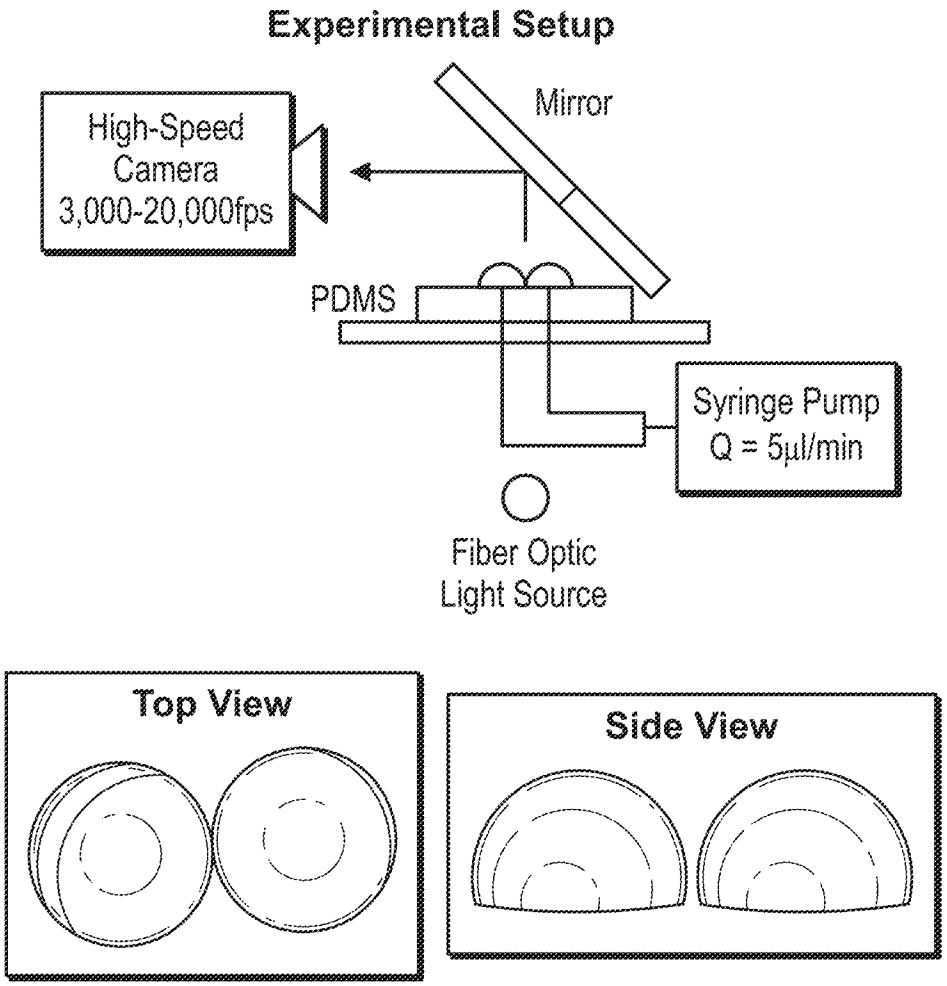
FIG. 11(*a*)-11(*b*) depicts an experimental setup for coalescence experiments of anchored-droplets as well as images of such droplets and a plot of bridge radius as a function of time associated with such droplets.
Figure 11B:
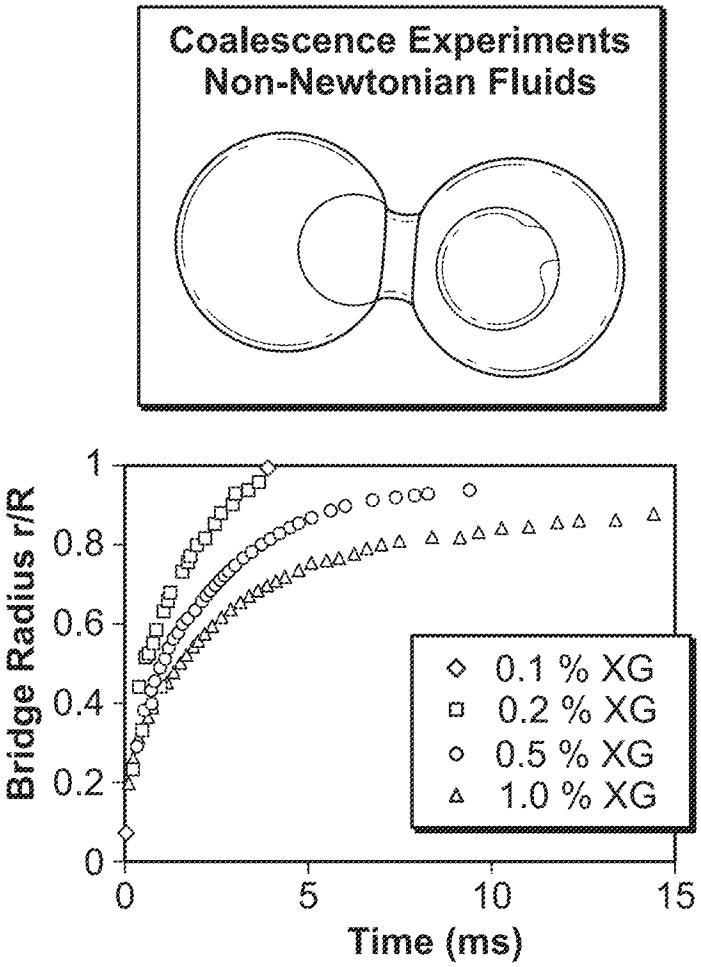

FIG. 11 depicts an experimental setup for coalescence experiments of anchored-droplets as well as images of such droplets and a plot of bridge radius as a function of time associated with such droplets. In particular, FIG. 11 depicts experimental set up in which a high-speed camera captures imagery associated with the formation of anchored-droplets being formed by a liquid injected from a bottom portion in a PDMS layer using a syringe pump. A mirror allows the capture of both top and side views of the droplets with a high-speed camera such that the coalescence behavior of non-Newtonian droplets (e.g., Xanthan Gum) is captured as shown in FIG. 11. The setup may be adapted for flow-induced coalescence studies.

Various embodiments are directed to the separation of oil-in-water and water-in-oil emulsions using mesoscale models and microdevices with connected anchored-fluid elements. The separation of oil-in-water and water-in-oil emulsions are relevant to a variety of industries. In one end, produced water (or oily wastewater) is generated in the oil industry, with typically less than 1 g/L of total oil content, which needs to be reduced below 10 mg/L before discharge. In the opposite end, emulsions of water in crude oil can contain as much as 20% water. In all cases, one of the difficulties is to remove droplets of the disperse phase with sizes below 20 μm. Of interest to these embodiments is the use of advanced materials with special wettability related characteristics, such as superhydrophobic and superoleophilic as well as superhydrophilic and superoleophobic membrane. Some embodiments use hierarchically-structured membranes that, after they are pried with water, would prevent oil from displacing the trapped water, thus acting as underwater superoleophobic materials. A complementary approach is used in that the array elements have high affinity (even the same) as the disperse phase and thus act as supercollectors/supercoalescers. Specifically, arrays of anchored-fluid bridges that are connected to a reservoir of the same fluid, as shown in FIG. 8*b* and flow an emulsion of droplets that depending on working condition coalesces onto the anchored-fluid elements and could be removed.

The inventors have determined that close to the critical orientation of the device, there is observed a supercoalescence due to the fact that locking trajectories act as irreversible attractors to the motion of the drops thus leading to possibly perfect coalescence efficiency.

In various embodiments, aluminum, PMMA, PDMS and/or PTFE flat surfaces are used to fabricate a bottom channel. This provides flexibility with respect to the wetting conditions, especially for water drops. Special paints may be used to modify surface properties as needed. Illustratively, 500 μm holes are drilled to deposit drops that range from 1 μL to 100 μL. The top channel may be made of transparent Plexiglas or glass for visualization the anchored-fluid elements under cross-flow. To investigate confinement effects, spacers of illustratively 100 μm-1 mm are used to control the height of the channel.

Various embodiments utilize microfabrication techniques wherein fabrication of the chambers with surface traps (e.g., as shown in FIG. 7) to anchor droplets is provided using standard soft lithography techniques. The process involves first drawing the desired trap patterns (e.g. diameter, spacing) and printing it onto high-resolution transparency photomasks. A layer of photoresist with desired thickness (determines the height of the posts or depth of the trenches) are then spin coated on a silicon wafer. The photoresist layer is then exposed to UV radiation (duration and intensity depends on the type and thickness of the resist) through the photomask. Unexposed photoresist is subsequently removed by soaking the wafer in photoresist developer followed by washing and drying steps. Poly(dimethylsiloxane) (PDMS) base and its curing agent will be mixed, degassed, and poured onto this photoresist master and cured overnight in an oven. After thermal curing, the PDMS layers are peeled off the master, inlet and outlet holes are punched, and the PDMS replicas are bonded to PDMS or glass surfaces by exposing them to air plasma.

FIG. 12 graphically illustrates a microfabrication method to achieve a porous membrane with the periodic array of holes suitable for use in the various embodiments. Specifically, FIG. 12 depicts a method to fabricate a membrane/device (porous PDMS films for use therein) when anchored-fluid elements are connected to a reservoir as per, e.g., FIG. 8*b*.

Figure 12A:
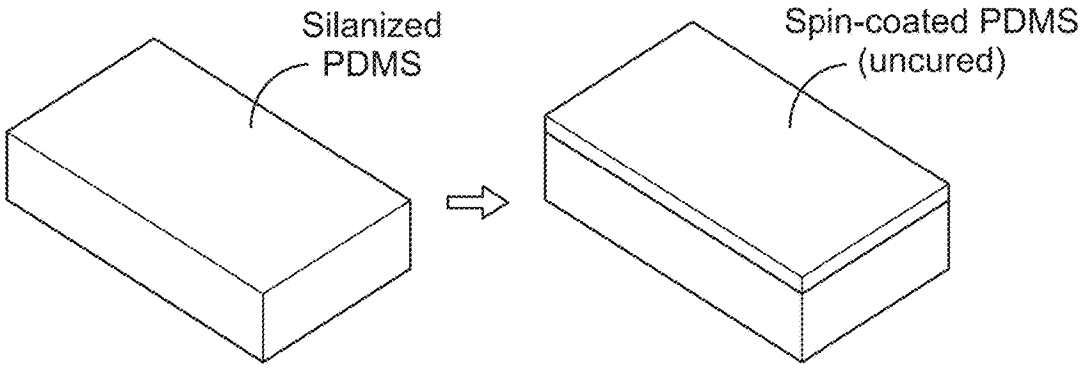
FIG. 12(*a*)-12(*d*) graphically illustrates a microfabrication method to achieve a porous membrane with the periodic array of holes suitable for use in the various embodiments.
Figure 12B:
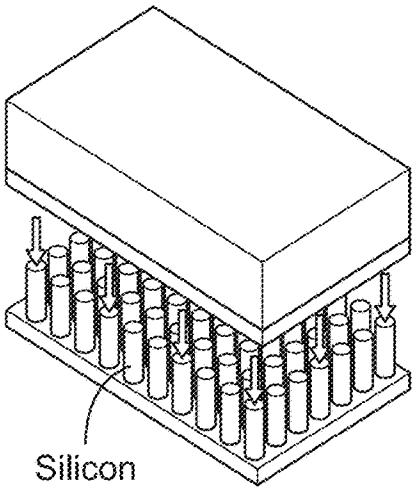
Figure 12C:
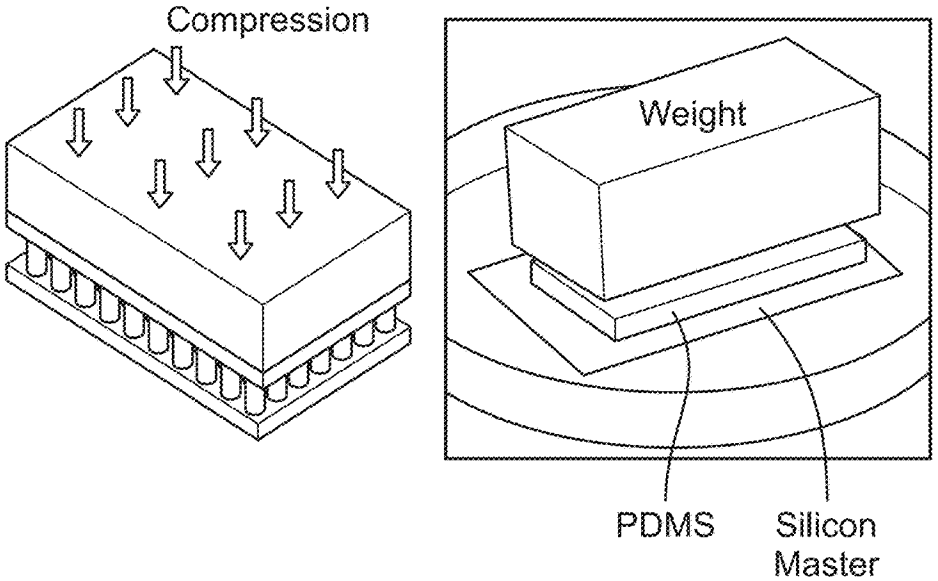
Figure 12D:
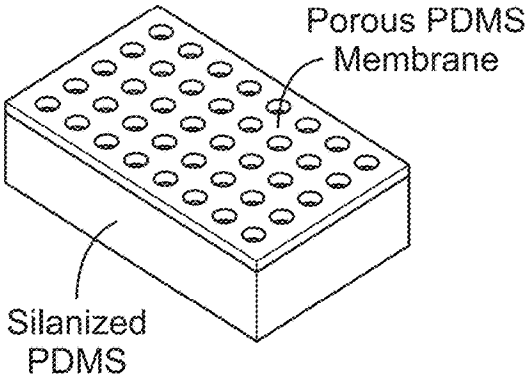

Initial steps provide for the fabrication of silicon micropillars followed by silanizing them to facilitate the subsequent peel off process after which a PDMS film with desired thickness is spin-coated on a silanized PDMS slab to form a film of uncured PDMS (FIG. 12*a*). The PDMS slab is placed on the array of microfabricated pillars (FIG. 12*b*) and compressed uniformly as PDMS is being cured (FIG. 12*c*). After complete curing of PDMS, the silicon master is removed leaving the PDMS membrane with microfabricated through-holes that are attached (reversibly) to the silanized PDMS surface (FIG. 12*d*).

For anchored-fluid elements and arrays, after the microposts and microwells are fabricated and enclosed in a channel, the anchored-fluid elements may be created by a displacement method. The channel is first filled with fluid (e. g. water), which is then displaced with a second fluid (e. g. oil or air). As the first fluid is displaced, it leaves behind anchored-droplets (see, e.g., results with air displacing water in FIG. 9*d*). Alternative fabrication methods are also available if necessary. An advantage of the proposed systems is that they are easily cleaned and reused. There are similar displacement approaches where instead of anchoring wells a micro-contact printing is used to create patch arrays with contrasting wetting properties, as shown in FIG. 7*a*.

Figure 13:
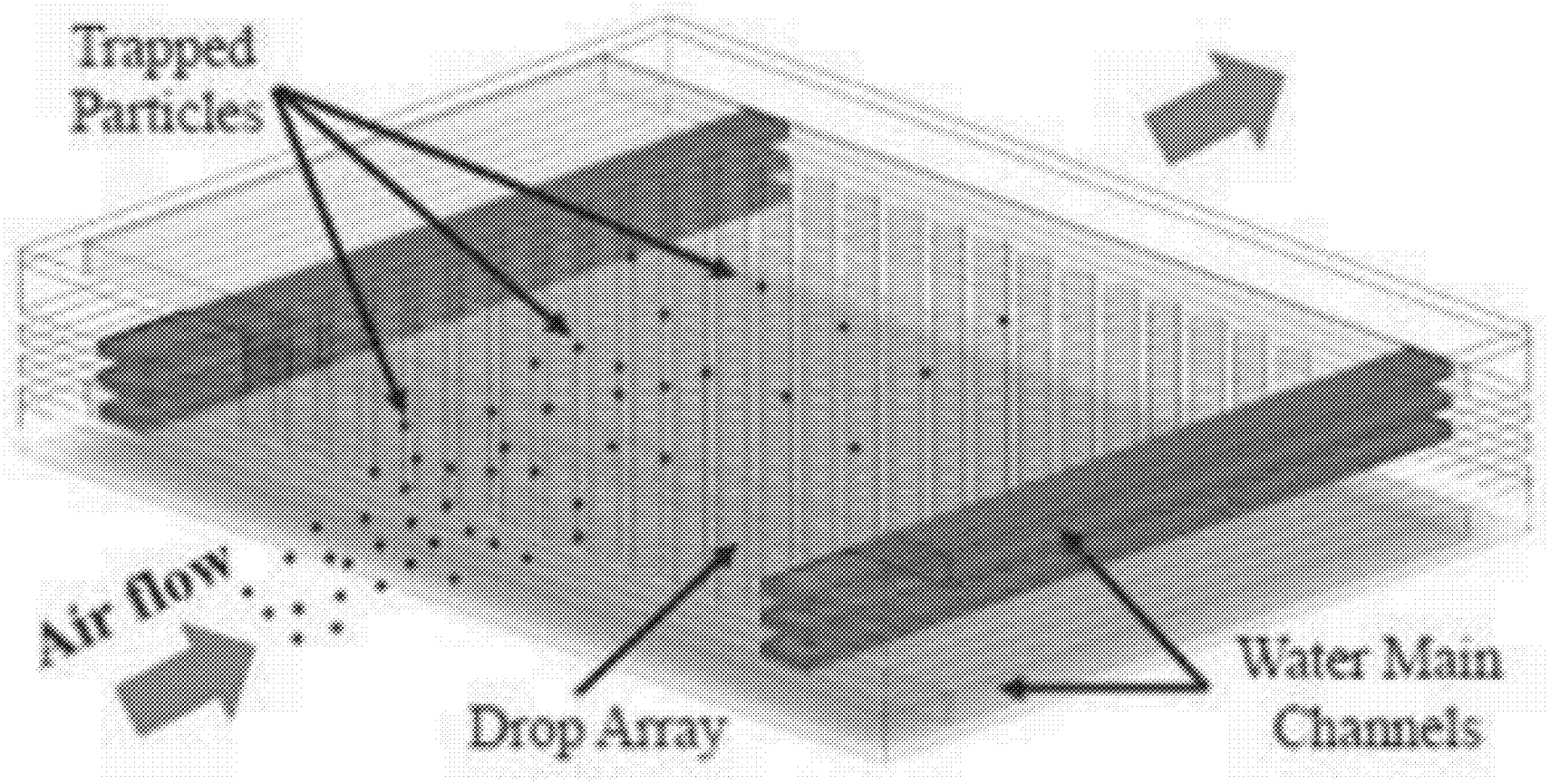
FIG. 13 depicts an exploded orthogonal view of an air filtration system according to an embodiment.

FIG. 13 depicts an exploded orthogonal view of an air filtration system according to an embodiment. In particular, FIG. 13 depicts an anchored-drop array with an air flow passing therethrough wherein particles within the airflow are trapped within the array in accordance with the various mechanisms discussed herein. It is noted that the air filtration system includes a plurality of water main channels configured to provide water to the anchor points associated with the anchored-drop array. The air filtration system may be cleaned and refreshed by expressing the water (or other fluid) used to form the anchored-liquid drops of the array. Such expression may be via the application of higher pressure air or other fluid forcing the anchored-liquid drops out of the air filtration system, the compression of top and bottom portions of the air filtration system such that the liquid is squeezed out, or by some other means.

In various embodiments, the liquid columns comprise static or unmoving liquid disposed between the top and bottom reservoirs of liquids. In various embodiments, the liquid disposed between the top and bottom reservoirs is dynamic or flowing between the top and bottom reservoirs, thus continuously refreshing or renewing the filter.

Figure 14:
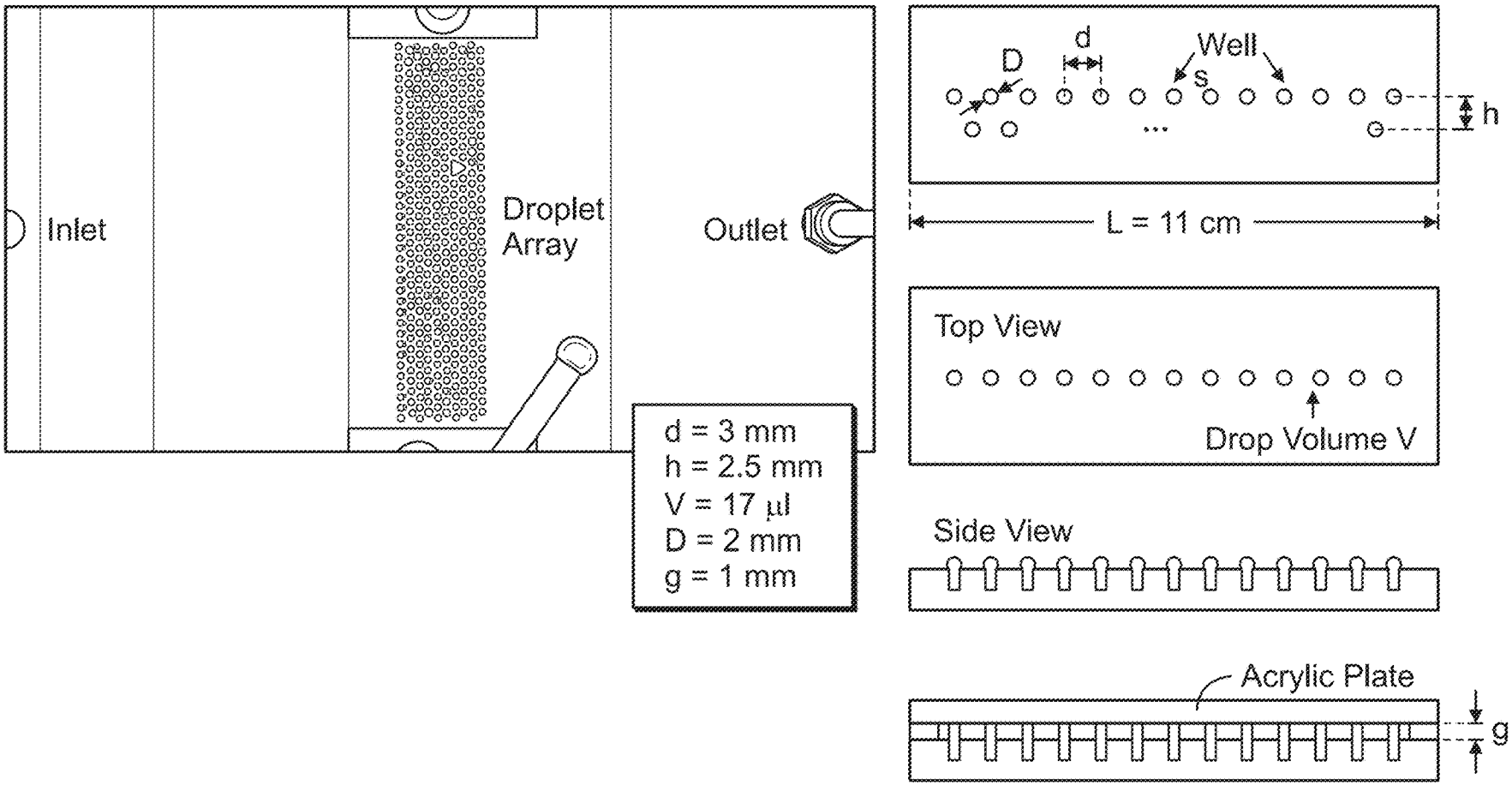
FIG. 14 depicts an exemplary prototype air filtration device in accordance with various embodiments.

FIG. 14 depicts an exemplary prototype air filtration device in accordance with various embodiments such as described above with respect to FIG. 13. In particular, FIG. 14 depicts a droplet array disposed between an air inlet and an air outlet, wherein transparent acrylic top and bottom plates are used to enable visibility of the array. The array comprises a plurality of rows of liquid-anchor drops wherein each row is approximately 11 cm long, the distance d between each drop is approximately 3 mm, the height h of each row is approximately 2.5 mm (measured with respect to anchored drop center points), the volume V of each drop is approximately 17 μL, the diameter D of each drop is approximately 2 mm and the distance g between top and bottom acrylic plate is approximately 1 mm.

The various embodiments described above provide great efficacy and filtration, separation and other applications. Experimental data shows that particles captured by a single row of liquid columns generally comprise those particles with the trajectory directly toward the particular column whereas those particles not captured by the liquid column generally comprise those particles with a trajectory that misses the particular column. With a plurality of rows of liquid columns (i.e., an array of liquid columns), the vast majority of the particles will have a trajectory directly toward a column within the array.

Gaseous Fluid/Air Column Embodiments

The various embodiments described above are directed toward arrays of anchored-liquid columns disposed within a medium such as air, oil or some other gas or liquid medium wherein particles suspended within medium flowing through an array of anchored-liquid columns are either captured or diverted (i.e., have their trajectories modified) such that a filtration/separation of the particles from the suspension medium may be provided.

Various other embodiments contemplate the use of anchored-gas columns (e.g., air or other gaseous material) rather than anchored-liquid columns wherein rather than liquid drops anchored as described above, the columns are formed by a pockets or "drops" of air confined proximate anchor points via surface tension associated with liquid surrounding the anchor points, hydrophobic repelling of liquid surrounding the anchor points, static/constant pressurization of gas at the anchor points, dynamic/modulated pressurization of gas at the anchor points and/or other techniques.

Generally speaking, each of the various anchored-liquid column array embodiments or components thereof as described above may also be implemented as an anchored-gas column array or component thereof.

FIG. 7 as described above depicts various anchor mechanisms including those associated with through-holes such that a liquid may be injected at the anchor point to form thereby an anchored-liquid bridge. Partial and full wetting embodiments are also described.

In various anchored-gas embodiments, the liquid droplets depicted with respect to the embodiments of FIG. 7 instead comprise gas "droplets" surrounded by liquid. For example, an anchored-gas bridge may be formed in a manner similar to the anchored-liquid bridge of FIG. 7*b*. Specifically, FIG. 7*b* depicts an anchored-liquid bridge wherein a drop of liquid disposed between top and bottom plates separated by a height h may exhibit concave or convex edge shapes depending upon whether partial wetting or complete wetting is utilized. Further, the minimum width of a cylindrical post of liquid forming the anchored-liquid bridge may also be adapted as described above. Within the context of an anchored-gas bridge, a small amount of gas (e.g., air) is "anchored" at the anchor point to form thereby an anchored-gas bridge within, illustratively, an array of anchored-gas bridges suitable for use in performing the various filtering/separation functions described herein.

In one embodiment, an anchored-gas array is formed using a plurality of anchor points wherein each anchor point comprises an opening in one or both of the top and bottom plates of the array enclosure, wherein at least one of the openings is further associated with a source of pressurized gas, and wherein the pressurized gas is precisely introduced to the anchor points in a manner resulting in the existence of localized air drops, bubbles or pockets configured to impede the flow of a liquid passing therethrough such that particles within the liquid are captured by, or have their trajectories diverted by, one or more of the anchored gas array elements forming the anchored gas array.

Figure 15:
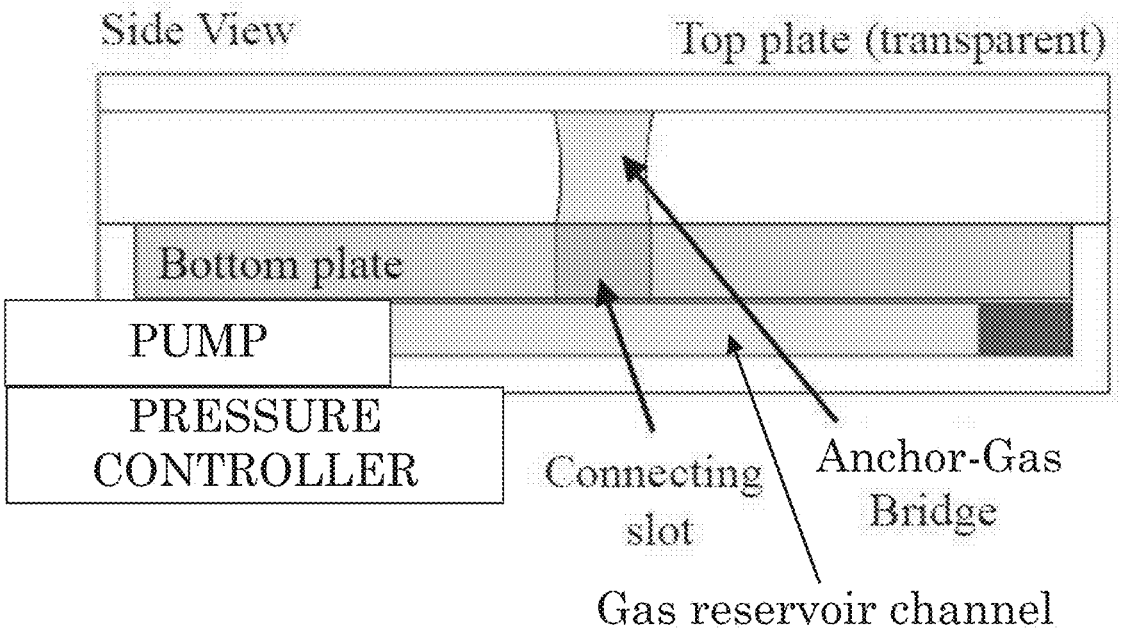
FIG. 15 depicts a testing section of an experimental setup for examining the structure of an individual anchored-gas/gas-bridge element.

FIG. 15 depicts a testing section of an experimental setup for examining the structure of an individual anchored-gas/gas-bridge element. Specifically, FIG. 15 depicts examples of anchored-gas elements being connected to a reservoir of the same gas, wherein a pressure and/or other parameters associated with the gas are sensed by a pressure controller which responsively causes a pump to keep the pressure at a predefined level. The predefined level of pressure is associated with an amount of pressure determined to be appropriate to create and/or maintain an anchored-gas bridge element such as within an array of anchored-gas bridge elements in accordance with the various embodiments described herein.

In various embodiments, the pump and pressure controller are used to provide pressurized gas to all of the anchored-gas bridges within an array. In various embodiments, a respective pump and/or pressure controller is used to provide pressurized gas to a respective group or region of anchored-gas bridges within the array. In various embodiments, the gas reservoir channel is sealed and the pressure controller operates to increase or decrease pressure via mechanical force applied to an outer wall of the gas reservoir channel, such as via a micro electromechanical (MEMS) device. For example, in various embodiments one or more gas reservoirs are used to provide initially pressurized gas to each of a plurality of anchor points to develop thereby initial anchored-gas bridges. Individual MEMS devices may be included at each of the anchor points to increase and/or decrease pressure at the anchor point to ensure that the anchored-gas bridge at that anchor point is appropriately formed. Various other modifications to adapt anchor point gas pressure are also contemplated.

In one embodiment, a particle separation apparatus is formed as an array of anchored-fluid drops (liquid or gas) disposed between first and second surfaces to partially obstruct thereby a channel for receiving therethrough a fluid flow, the array generally formed as rows and columns of fluid drops (liquid or gas) anchored via respective anchoring structures formed on the first surface and configured for obstructing proximate portions of the fluid flow, the array positioned to receive the fluid flow at a forcing angle selected to cause a separation of particles of different predefined sizes within the fluid flow.

In other embodiments, the particle separation apparatus comprising anchored-gas drops or bubbles may include least one gas reservoir channel configured to provide pressurized gas to a respective portion of the anchoring structures via the anchoring structures formed on the first surface, the pressurized gas being configured to exert sufficient pressure on surrounding fluid to maintain the array of anchored-gas drops or bubbles.

In various embodiments, particles are filtered/separated from each other or the fluid flow by redirecting particles via anchored-fluid drops and/or by trapping the particles within anchored-fluid drops by forcing particles through the fluid flow-fluid drop interface such that the particles eventually come to rest within the anchored-fluid drop.

Figure 16B:
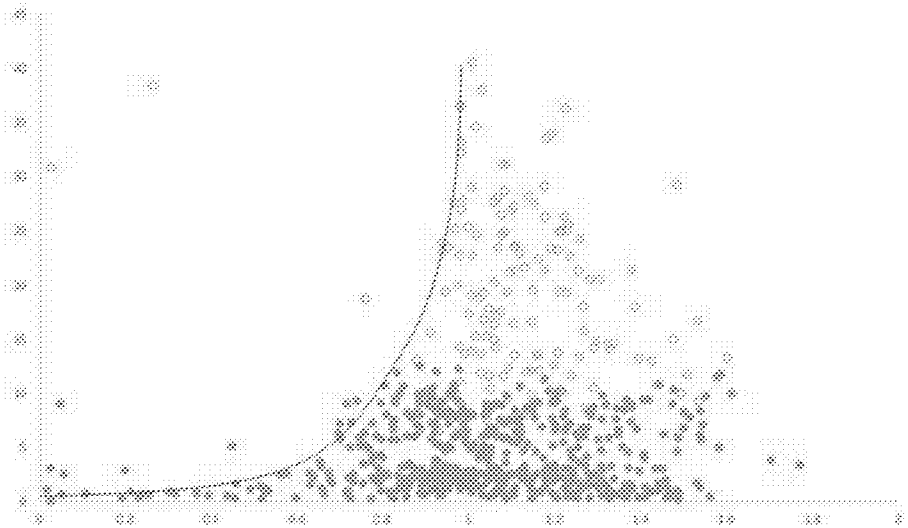
FIGS. 16A and 16B graphically depict experimental results useful in understanding the various embodiments.
Figure 16A:
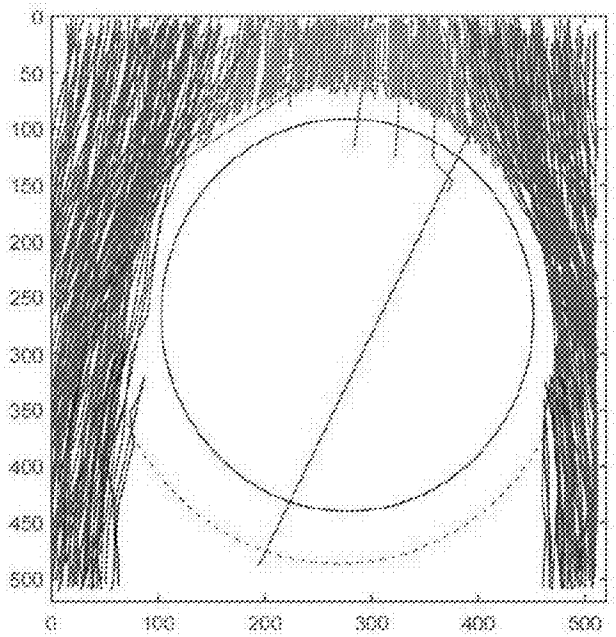

FIGS. 16A and 16B graphically depict results of an experimental investigation into the efficiency of airborne particle capture by a single liquid bridge or column.

FIG. 16A graphically depicts downward looking view of a liquid column (the center circular disk) as well as the individual trajectories of each of a plurality of particles generally directed toward or near the liquid column via a flow of air. It can be seen by inspection that the darker trajectories correspond to particles that were not captured by the liquid column (i.e., those particles that missed the liquid column or impacted the liquid column at a very slight angle), while the lighter trajectories correspond to particles that were captured by the liquid column (i.e., those particles that impacted the liquid column at more than the very slight angle).

Each of these particles may be associated with a Stokes number (i.e., a number that measures the inertia of the particle) and an incoming position (i.e., bin). In particular, particles having trajectories more directly approaching or impinging upon the liquid column are efficiently captured while particles having trajectories not directly approaching or impinging upon the liquid column are not captured. Given an array of columns of sufficient size, substantially all particles will have a trajectory that approaches and impinges upon at least one liquid column and, therefore, substantially all particles will be captured by a liquid column within such an array of columns.

FIG. 16B graphically depicts Stokes number as a function of incoming position or bin for particles of differing size and differing incoming velocities that are not captured by the liquid column. Substantially all the particles to the left of the solid line have been captured by the liquid column, whereas particles to the right of the solid line has not been captured by the liquid column. This result demonstrates that particles of any size may be captured if the airflow carrying the particles is of sufficient velocity. Stated differently, to capture particles of a specific size a corresponding specific airflow velocity may be calculated. This adaptation of airflow in response particle size may also be applied to other embodiments described herein for both liquid and gaseous flows through an array.

Further, it will be appreciated that arrays of different sizes and shapes may be provided depending upon the application. For example, arrays utilizing more columns per area will provide more opportunity for particles to directly impinge upon a column. More or fewer columns may be utilized depending upon an amount of filtration/separation desired. Greater or lesser flow velocity may be utilized depending upon an amount of filtration/separation desired. Other modifications to array size, shape, column size, number of columns, density of columns, forcing angle and so on are contemplated by the inventors and discussed herein. Although various embodiments which incorporate the teachings of the present invention have been shown and described in detail herein, those skilled in the art can readily devise many other varied embodiments that still incorporate these teachings. Thus, while the foregoing is directed to various embodiments of the present invention, other and further embodiments of the invention may be devised without departing from the basic scope thereof.

What is claimed is:

1. A particle filtration apparatus, comprising:

an array of anchored-fluid drops disposed upon a first surface having a channel for receiving therethrough a fluid flow, the array generally formed as rows and columns of fluid drops anchored via respective anchoring structures formed on said first surface and configured for obstructing proximate portions of said fluid flow, the array positioned to receive the fluid flow at a forcing angle selected to cause trapping of particles of a predefined size from the fluid flow at a fluid flow-fluid drop interface;

wherein the anchored-fluid drops comprise anchored-liquid drops;

wherein the fluid flow-fluid drop interface comprises an air-liquid interface and the trapped particles comprise pollutants within a flow of air.

2. The apparatus of claim 1, wherein said trapping comprises trapping particles of a predefined size within the anchored-fluid drop through the fluid flow-fluid drop interface.

3. A particle filtration apparatus, comprising:

an array of anchored-fluid drops disposed upon a first surface having a channel for receiving therethrough a fluid flow, the array generally formed as rows and columns of fluid drops anchored via respective anchoring structures formed on said first surface and configured for obstructing proximate portions of said fluid flow, the array positioned to receive the fluid flow at a forcing angle selected to cause trapping of particles of a predefined size from the fluid flow at a fluid flow-fluid drop interface;

wherein the anchored-fluid drops comprise anchored-liquid drops;

wherein said array of anchored-liquid drops are disposed between said first surface and a second surface, said first and second surfaces defining therebetween said channel.

4. The apparatus of claim 3, wherein each of said anchoring structures is associated with a reservoir of said liquid.

5. The apparatus of claim 3, wherein said anchored-liquid drops form respective liquid bridges between said first and second surfaces.

6. The apparatus of claim 4, wherein said liquid exhibits a wettability with respect to said first and second surfaces selected to cause said liquid bridges to comprise substantially cylindrical posts.

7. The apparatus of claim 4, wherein:

at least some of said liquid bridges between said first and second surfaces include liquid bridges between said anchoring structures formed on said first surface and corresponding anchoring structures formed on said second surface.

8. The apparatus of claim 7, wherein:

at least some of said first surface anchoring structures and corresponding second surface anchoring structures are associated with reservoirs of said liquid.

9. The apparatus of claim 8, wherein said first and second surfaces comprise surfaces of respective plates having connecting slots formed therethrough between said anchoring structures and fluid reservoir channels configured to include said liquid.

10. The apparatus of claim 3, wherein said first and second surfaces are separated by a distance h, and a diameter of said liquid bridges is selected as a function of said distance h.

11. The apparatus of claim 3, where said anchored-liquid drops exhibit high wettability with respect to said first surface.

12. The apparatus of claim 3, where said anchored-liquid drops exhibit low wettability with respect to said first surface.

13. The particle filtration apparatus of claim 3, wherein the fluid flow-fluid drop interface comprises an air-liquid interface and the trapped particles comprise pollutants within a flow of air.

14. The particle filtration apparatus of claim 3, wherein the fluid flow-fluid drop interface comprises a water-oil interface and the trapped particles comprise oil contaminants within a flow of water.

15. The particle filtration apparatus of claim 3, wherein the fluid flow-fluid drop interface comprises an immiscible liquid-liquid interface and the trapped particles comprise contaminants within a liquid flow.

16. A particle separation apparatus, comprising:

an array of anchored-fluid drops disposed upon a first surface having a channel for receiving therethrough a fluid flow, the array generally formed as rows and columns of fluid drops anchored via respective anchoring structures formed on said first surface and configured for obstructing proximate portions of said fluid flow, the array positioned to receive the fluid flow at a forcing angle selected to cause a separation of particles of different predefined sizes within the fluid flow;

wherein the anchored-fluid drops comprise anchored-liquid drops;

wherein the interface between fluid flow and liquid drop comprises an immiscible liquid-liquid interface.

17. The apparatus of claim 16, wherein said fluid flow comprises one of a microfluidic flow and a water flow.

18. A particle filtration method, comprising:

disposing an array of anchored-fluid drops disposed upon a first surface having a channel for receiving therethrough a fluid flow, the array generally formed as rows and columns of fluid drops anchored via respective anchoring structures formed on said first surface and configured for obstructing proximate portions of said fluid flow, the array positioned to receive the fluid flow at a forcing angle selected to cause trapping of particles of a predefined size from the fluid flow at a fluid flow-fluid drop interface, wherein the anchored-fluid drops comprise anchored-liquid drops;

wherein the fluid flow-fluid drop interface comprises an air-liquid interface and the trapped particles comprise pollutants within a flow of air.

* * * * *